US009617984B2

(12) United States Patent
Bergmann

(10) Patent No.: US 9,617,984 B2
(45) Date of Patent: Apr. 11, 2017

(54) HYDROSTATIC AXIAL PISTON MACHINE EMPLOYING A BENT-AXIS CONSTRUCTION

(71) Applicant: Linde Hydraulics GmbH & Co. KG, Aschaffenburg (DE)

(72) Inventor: Martin Bergmann, Schaafheim (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 314 days.

(21) Appl. No.: 14/449,191

(22) Filed: Aug. 1, 2014

(65) Prior Publication Data

US 2015/0075365 A1 Mar. 19, 2015

(30) Foreign Application Priority Data

Aug. 5, 2013 (DE) ..... 10 2013 108 406

(51) Int. Cl.
*F04B 1/20* (2006.01)
*F03C 1/06* (2006.01)
(Continued)

(52) U.S. Cl.
CPC ..... *F04B 1/2092* (2013.01); *F03C 1/0607* (2013.01); *F03C 1/0636* (2013.01);
(Continued)

(58) Field of Classification Search
CPC .... F03C 1/0607; F03C 1/0636; F03C 1/0671; F03C 1/0673; F04B 1/20; F04B 1/2085;
(Continued)

(56) References Cited

U.S. PATENT DOCUMENTS 2,633,104 A * 3/1953 Lauck ..... F01B 3/0047 91/505
3,267,871 A * 8/1966 Lee ..... F01B 3/0041 137/625.21
(Continued)

FOREIGN PATENT DOCUMENTS

DE 2805492 A1 8/1979
DE 3800031 A1 7/1989
(Continued)

*Primary Examiner* — Nathaniel Wiehe
*Assistant Examiner* — Logan Kraft
(74) *Attorney, Agent, or Firm* — The Webb Law Firm

(57) ABSTRACT

A bent-axis hydrostatic axial piston machine (1) has a drive shaft (4) rotatable around an axis of rotation ($R_t$) and having a drive flange (3). A cylinder drum (7) is rotatable around an axis of rotation ($R_z$). The cylinder drum (7) includes a plurality of piston bores (8) concentric to the axis of rotation ($R_z$) of the cylinder drum (7) and in each of which piston bores (8) there is a longitudinally displaceable piston (10). The pistons (10) are fastened in an articulated manner to the drive flange (3). Between the drive shaft (4) and the cylinder drum (7) there is a constant velocity driving joint (30) in the form of a cone-beam semi-roller joint (31).

30 Claims, 14 Drawing Sheets

(51) Int. Cl.
*F04B 27/08* (2006.01)
*F04B 1/32* (2006.01)

(52) U.S. Cl.
CPC ..... *F03C 1/0671* (2013.01); *F03C 1/0673* (2013.01); *F04B 1/20* (2013.01); *F04B 1/2085* (2013.01); *F04B 1/328* (2013.01); *F04B 27/086* (2013.01); *F04B 27/0865* (2013.01); *F04B 27/0869* (2013.01)

(58) Field of Classification Search
CPC ..... F04B 1/2092; F04B 1/328; F04B 27/086; F04B 27/0865; F04B 27/0869; F16D 3/24
See application file for complete search history.

(56) References Cited

U.S. PATENT DOCUMENTS 3,566,746 A * 3/1971 Harrison ..... B63H 25/22 91/6.5
4,920,860 A * 5/1990 Alm ..... F04B 1/24 91/504
8,850,953 B2 10/2014 Roth

FOREIGN PATENT DOCUMENTS

DE 102005057988 A1 2/2007
DE 102007011441 A1 9/2008
DE 102009005390 A1 7/2010

* cited by examiner 40
67F
25
55b
26
50b
27
A
50
3
50a
SP
4
70
S
67F
56a
57a
30, 31
42
51
A
E
SP
F
57b
Rt
Rt
Rt

HYDROSTATIC AXIAL PISTON MACHINE EMPLOYING A BENT-AXIS CONSTRUCTION

CROSS REFERENCE TO RELATED APPLICATIONS

This application claims priority to German Application No. DE 102013108406.0 filed Aug. 5, 2013, which is herein incorporated by reference in its entirety.

BACKGROUND OF THE INVENTION

Field of the Invention

This invention relates to a hydrostatic axial piston machine employing a bent-axis construction with a drive shaft rotatable around an axis of rotation and having a drive flange. A cylinder drum is rotatable around an axis of rotation. The cylinder drum has a plurality of piston bores that are concentric to the axis of rotation of the cylinder drum. A longitudinally displaceable piston is located in each piston bore. The pistons are fastened in an articulated manner to the drive flange. Between the drive shaft and the cylinder drum there is a driving joint in the form of a constant velocity joint for rotationally synchronous rotation of the cylinder drum and the drive shaft.

Description of Related Art

In hydrostatic axial piston machines that utilize a bent-axis construction, the longitudinally displaceable pistons located in the cylinder drum are generally fastened to the driving flange of the drive shaft by a ball-and-socket joint. The piston forces are supported via the pistons on the driving flange that is located on the drive shaft and generate a torque. In axial piston machines that utilize a bent-axis construction, during rotation there is naturally no driving of the cylinder drum with the pistons located in it. An additional device is necessary to drive the cylinder drum.

During rotation of the drive shaft, it is desirable to have the most synchronous possible driving and rotation of the cylinder drum. In the event of a non-uniform rotation of the cylinder drum, the moment of inertia of the cylinder drum with the pistons located in it would cause a non-uniform torque on the drive shaft. A non-uniform torque can result in critical stresses on the components of the axial piston machine. Undesirable noises can also occur in a drive train of which the axial piston machine is a part on account of the non-uniform torque.

To achieve a synchronous rotation of the cylinder drum and the drive shaft, on known axial piston machines that employ a bent-axis construction, constant velocity joints are used as the drive link for the rotationally synchronous drive of the cylinder drum. On known bent-axis axial piston machines, constant velocity joints that employ the Rzeppa principle are used in which roller bodies in the form of spheres (balls) that run in groove-shaped tracks in the drive flange and the cylinder drum transmit the torque between the drive shaft and the cylinder drum. Alternatively, the tripod principle is used, in which between the cylinder drum and the drive shaft there is a coupling shaft provided on both ends of the shaft with finger-like bearing pins on which are mounted the roller-shaped roller bodies that run in corresponding grooves (tracks) on the drive flange and the cylinder drum and transmit the torque to drive the cylinder drum. An axial piston machine that employs a bent-axis construction with a constant velocity joint according to the Rzeppa principle is known from DE 38 00 031 C2. Although constant velocity joints of this type that utilize the Rzeppa principle or the tripod principle result in a rotationally synchronous drive of the cylinder drum, they are difficult and expensive to manufacture on account of the complex tracks for the balls or rollers. In addition, at sufficiently high levels of torque to be transmitted to drive the cylinder drum, high Hertzian stresses occur on the roller bodies, which in constant velocity joints of this type are in the form of balls or rollers and require that the tracks be hardened to a significant depth. During the necessary hardening by a suitable heat treatment of the components provided with the tracks for the roller bodies, a change in the dimensions of the hardened components that contain the tracks occurs, which requires complicated, expensive, and time-consuming mechanical reworking operations on the hardened components. In other words, constant velocity joints that employ the Rzeppa or tripod principle require a high level of manufacturing effort and expense for the bent-axis machine.

In axial piston machines that utilize a bent-axis construction, it is known that the cylinder drum can be driven by connecting rods which are at least partly located in the piston and are connected in an articulated manner with the piston and with the drive flange by a ball-and-socket joint. The connecting rods for driving the cylinder drum are supported on the piston inside walls of the piston bores of the cylinder drum. A bent-axis axial piston machine in which the cylinder drum is driven by connecting rods is described in DE 28 05 492 C2.

Also known are bent-axis axial piston machines in which the cylinder drum is driven directly by the longitudinally displaceable pistons in the piston bores of the cylinder drum. These pistons are tapered and are provided with a tapered lateral surface. The pistons for driving the cylinder drum are supported for the drive of the cylinder drum with the tapered segments on the inside walls of the piston bores of the cylinder drum. A bent-axis axial piston machine with a drive of the cylinder drum by tapered pistons is described in DE 10 2009 005 390 A1.

In axial piston machines that utilize a bent-axis construction with drive of the cylinder drum by connecting rods or by pistons, however, on account of the limited number of pistons or connecting rods, it is not always possible to achieve an exactly rotationally synchronous drive of the cylinder drum and, thus, there is a non-uniformity of the rotational motion in the driving of the cylinder drum. A further disadvantage of bent-axis axial piston machines with a cylinder drum driven by connecting rods or pistons is that when the axial piston machine is a variable displacement machine, when the cylinder drum pivots back to a lower displacement volume, there is play between the cylinder drum and the drive shaft. The play results in an undesirable lack of synchronization between the drive shaft and the cylinder drum, which leads to an additional tangential orientation of the connecting rods or of the tapered pistons. The tangential orientation of the connecting rods or of the tapered pistons results in tangential force components that lead to a high level of reactive torque, which must be transmitted via the connecting rods or pistons, which in turn results on high stresses on the components in terms of strength and tribology.

On bent-axis axial piston machines of the type described above, an additional disadvantage is that the drive shaft cannot be routed through the axial piston machine because the constant velocity joints (according to the Rzeppa principle or according to the tripod principle) are located at the intersection of the axis of rotation of the cylinder drum with the axis of rotation of the drive shaft. Or when the cylinder drum is driven by connecting rods or by the pistons, the cylinder drum is mounted on a center pin that is located concentric to the axis of rotation of the cylinder drum. On axial piston machines that utilize the bent-axis construction with a constant velocity joint for the drive of the cylinder drum when the axial piston machine is in the form of a motor, the output of the torque, and when the axial piston machine is in the form of a pump, the drive by a torque, can occur only on one side, as a result of which the potential applications of the axial piston machine are limited. For applications of bent-axis machine in which torque is to be output on both sides or a torque for the operation of an additional consumer must be transferred through the axial piston machine, on known bent-axis axial piston machines, additional components (such as transfer cases) are necessary to make possible a universal use of the axial piston machine.

On known bent-axis axial piston machines in which a constant velocity joint that utilizes the Rzeppa principle or the tripod principle is used for the drive of the cylinder drum or in which the cylinder drum is driven by connecting rods or by the pistons, a further disadvantage is that the drive shaft equipped with the drive flange must be mounted in a cantilevered fashion in a housing of the axial piston machine. The overall length of the axial piston machine is increased by the requirement for a bearing base for the two bearings of the drive shaft.

SUMMARY OF THE INVENTION

It is an object of the invention to provide an axial piston machine utilizing a bent-axis construction of the general type described above but which has an exactly rotationally synchronous drive of the cylinder drum with little construction effort or expense for the driving joint, which is simplified in terms of the construction effort required and can be used in a simple manner for universal applications.

This object is accomplished according to the invention by constructing the driving joint in the form of a cone-beam semi-roller joint. With a driving joint in the form of a cone-beam semi-roller joint, a drive of the cylinder drum in a bent-axis axial piston machine can be achieved with little construction effort or expense for the driving joint. A cone-beam semi-roller joint between the drive shaft and the cylinder drum can be easily incorporated by an appropriate geometric design in the form of a homokinetic constant velocity joint in which there is an exact and uniform drive of the cylinder drum. In addition, with a cone-beam semi-roller joint as the constant velocity joint located between the drive shaft and the cylinder drum as the driving joint for the drive of the cylinder drum, it becomes simple to extend the drive shaft through the axial piston machine in the axial direction so that the axial piston machine is suitable for universal applications, in which as the result of the torque transfer capability, it becomes possible to tap the torque on both sides of the drive shaft, or to transfer a torque for the drive of an additional consumer through the axial piston machine.

In one advantageous embodiment of the invention, the cone-beam semi-roller joint is formed by at least one pair of rollers with two semi-cylindrical half-rollers. The semi-cylindrical half-rollers are flattened along an axis of rotation and these half-rollers form planar sliding surfaces on the flattened sides, on which the half-rollers of the roller pair are in contact with each other. The half-rollers of a roller pair are each arranged in pairs. The half-rollers of a roller pair of the cone-beam semi-roller joint are formed by cylindrical bodies flattened along the axis of rotation and therefore along the longitudinal axis of the flattened cylindrical bodies. As a result of the flattening, flat sliding surfaces are formed as contact surfaces on the flattened sides of the half-rollers, on which the two half-rollers of a roller pair are in contact with each other and the force is transmitted by contact between the flat surfaces. With roller pairs of this type, each of which has two semi-cylindrical half-rollers, the half-rollers of which are flattened along an axis of rotation and thus along the longitudinal axis of the half-rollers, and which are in contact with one another on the flattened side between flat sliding surfaces, the forces and the torque for the drive of the cylinder drum can be transmitted with little added construction effort or expense because the half-rollers can be manufactured simply and economically. Because the contact surfaces between the two half-rollers of a roller pair are in the form of flat sliding surfaces and there is area contact between the two half-rollers of a roller pair, even in the event of high forces transmitted during driving of the cylinder drum, the Hertzian stresses that occur are low. The cone-beam semi-roller joint formed by the corresponding roller pairs is therefore robust enough to withstand an overload of the type that can occur, for example, as a result of high rotational acceleration. When the axial piston machine is a hydraulic motor, the axial piston machine can also be used in applications with high rotational accelerations. As a result of the area contact in the vicinity of the contact surfaces of the two half-rollers of a roller pair, the only treatment that is required on the half-rollers of the conical beam half-roller joint is a treatment of the flattened sides to protect them against wear. With a treatment of this type with limited surface hardening, only negligible, process-induced changes in the dimensions of the half-rollers occur, so that mechanical refinishing or reworking of the half-rollers is not necessary. The cost and effort required for the manufacture of the bent-axis axial piston machine can be reduced because the cone-beam semi-roller joints are so simple to manufacture.

It is particularly advantageous if, as in one embodiment of the invention, the half-rollers are located in the radial direction inside the pistons and at a distance from the axis of rotation of the drive shaft and of the cylinder drum. The cone-beam semi-roller joint is therefore inside the rim and the reference circle of the pistons, as a result of which a compact construction of the axial piston machine becomes possible. In addition, the half-rollers of the roller pairs are at perpendicular distances from the axis of rotation of the drive shaft and the axis of rotation of the cylinder drum so that the torque to drive the cylinder drum can be transmitted on the contact surfaces formed by the planar sliding surfaces. This arrangement of the half-rollers of the cone-beam semi-roller joint also makes it possible in a simple manner to route the drive shaft through the cylinder drum and the axial piston machine and create a torque transfer capability.

In one advantageous embodiment of the invention, each pair of rollers has one cylinder-drum-side half-roller that belongs to or is associated with the cylinder drum and one drive shaft-side half-roller that belongs to or is associated with the drive shaft, so that the forces and a torque to drive the cylinder drum can be transmitted in a simple fashion.

In one preferred embodiment of the invention, the cylinder-drum-side half-roller of a roller pair is located in a cylindrical or partly cylindrical cylinder-drum-side receptacle and the drive-shaft-side half-roller of a roller pair is located in a cylindrical or a partly cylindrical drive-shaft-side receptacle. Receptacles of this type in which the corresponding half-roller is retained and embedded, can be manufactured easily and economically, as a result of which, in connection with the half-rollers themselves, which are also simple and economical to manufacture, the driving joint for the drive of the cylinder drum can be produced with little manufacturing effort and expense.

In one embodiment of the invention, the axis of rotation of the drive shaft-side half roller is inclined at an angle with respect to the axis of rotation of the drive shaft and intersects the axis of rotation of the drive shaft. If a plurality of drive shaft-side half-rollers are provided, their axes of rotation form a cone-beam with reference to the drive shaft.

Accordingly, the axis of rotation of the cylinder-drum-side half roller is inclined at an angle with reference to the axis of rotation of the cylinder drum and intersects the axis of rotation of the cylinder drum. If a plurality of cylinder-drum-side half rollers are provided, their axes of rotation likewise form a cone-beam with reference to the cylinder drum.

It is particularly advantageous if, as in one embodiment of the invention, the angles of inclination are identical and intersect the axis of rotation of the cylinder-drum-side half-roller and the axis of rotation of the drive shaft side half-roller of each pair of rollers in a plane which is perpendicular to the line bisecting the angle between the axis of rotation of the drive shaft and the axis of rotation of the cylinder drum. The half-rollers of a roller pair are located in the vicinity of the intersection of the axes of rotation of the half-rollers. If the angle of inclination of the axes of rotation of the half-rollers for the drive shaft and for the cylinder drum (and, thus, for the two components to be coupled together) are equal and therefore identical, it is achieved that the respective axes of rotation of the half-rollers that belong to the drive shaft intersect in pairs and, therefore, for each pair of rollers with the axes of rotation of the half-rollers that belong to the cylinder drum in a plane that is inclined at one-half the pivoting angle. The pivoting angle equals the angle of inclination of the axis of rotation of the cylinder drum with respect to the axis of rotation of the drive shaft. The points of intersection of the axes of rotation of the pairs of rollers therefore lie in a plane which is perpendicular to the line bisecting the angle between the axis of rotation of the drive shaft and the axis of rotation of the cylinder drum. The transmission of force to drive the cylinder drum occurs at these points of intersection on the two half-rollers of each pair in contact with each other at the flat sliding surfaces. The position of the points of intersection of the axes of rotation of the half-rollers of each roller pair on the line bisecting the angle means that the perpendicular (and, thus, radial) distances of the points of intersection from the axis of rotation of the cylinder drum and from the axis of rotation of the drive flange are equal. The equal lever arms formed by the equal distances result in equal angular velocities and, thus, a uniform rotation. The realization of equal angles of inclination of the half-rollers of the roller pairs of the cone-beam semi-roller joint, makes it possible to design the cone-beam semi-roller joint in the form of a constant velocity joint, which with little added construction effort and expense makes possible a rotationally synchronous drive of the cylinder drum.

The axial piston machine can be operated in only one direction of rotation. It is sufficient for this direction of rotation to provide one or more pairs of rollers that make possible a transmission of the drive torque in the desired direction of rotation between the drive shaft and the cylinder drum.

If the axial piston machine, as in one development of the invention, can be operated in both directions of rotation, it is particularly advantageous if at least one pair of rollers is provided for each direction of rotation for the rotationally synchronous drive of the cylinder drum and the transmission of a drive torque. This arrangement achieves in a simple manner a transmission of the drive torque in both directions of rotation between the drive shaft and the cylinder drum.

Depending on the torque to be transmitted between the drive shaft and the cylinder drum, if the torques to be transmitted are sufficiently low, it may be sufficient to provide only a single pair of rollers for each direction of rotation and, thus, each direction of torque of the drive torque. For higher torques to be transmitted between the drive shaft in the cylinder drum, the number of roller pairs for the corresponding direction of rotation can be increased. If a plurality of roller pairs, in particular at least two roller pairs, are distributed, preferably uniformly, over the periphery, a radial equalization of forces for each direction of the drive torque is achieved.

In one embodiment of the invention, the at least one roller pair in the longitudinal direction of the cylinder drum can be located outside the cylinder drum.

If, as in one alternative embodiment of the invention, the at least one roller pair in the longitudinal direction of the cylinder drum is located at least partly inside the cylinder drum, a compact construction in the axial direction becomes possible, which makes possible the construction of the axial piston machine in the form of a compact axial piston machine in the axial direction.

In one development of the invention, the individual half-roller located in a cylindrical receptacle is secured in the receptacle in the longitudinal direction of the axis of rotation. This measure makes it possible to prevent the half-roller from slipping out of the respective individual cylindrical receptacle during operation of the axial piston machine.

A securing of the half-roller in the longitudinal direction of this type can be achieved with little added construction effort or expense if the half-rollers are provided on the cylindrical section with a collar which is engaged in a groove of the receptacle. A collar in the form of an annular collar, for example, or a groove in the form of an annular groove can be simply and economically provided on the corresponding half-roller or the corresponding receptacle, and makes it possible to axially secure the individual half-roller in the associated receptacle.

The drive-shaft-side receptacles for the drive-shaft-side half-rollers of the corresponding roller pairs can be located in the drive shaft or in the drive flange so that the drive shaft-side half-rollers of the corresponding roller pairs are supported directly on the drive shaft.

As an alternative to a direct support of the drive-shaft-side half-rollers of the corresponding roller pairs on the drive shaft, the drive-shaft-side receptacles can be located in a component that is connected with the drive shaft in a torque-proof manner. This arrangement can have advantages in terms of ease of manufacture and fabrication of the drive-shaft-side receptacles.

The component provided with the drive-shaft-side receptacles can be easily connected with the drive shaft in a torque-proof manner by a positive or non-positive torque connection.

In one embodiment of the invention, the drive flange can be formed in one piece on the drive shaft. In addition, it is alternatively possible to make the drive flange and the drive shaft separate pieces, in which case the drive flange is fastened on the drive shaft in a torque-proof manner. The drive flange is thereby separate from the drive shaft and can be connected torque-tight to the drive shaft by a suitable torque connection, such as a shaft-hub connection which can be formed by splined shaft teeth.

The cylinder-drum-side receptacles or the cylinder-drum-side half-rollers of the corresponding roller pair can be located directly in the cylinder drum, as a result of which the cylinder-drum-side half-rollers of the corresponding roller pairs are supported directly on the cylinder drum.

As an alternative to a direct support of the cylinder-drum-side half-rollers of the corresponding roller pairs on the cylinder drum, the cylinder-drum-side half-rollers can be located in a sleeve-shaped driver element connected with the cylinder drum in a torque-proof manner. This arrangement has advantages in terms of the simple manufacture of the cylinder-drum-side receptacles. The driver element provided with the cylinder-drum-side receptacles can be easily connected in a torque-proof manner with the cylinder drum by a positive or non-positive torque connection.

In one advantageous development of the invention, the driver element or the cylinder drum is provided with at least one finger-shaped protrusion which extends toward the drive shaft and in which a cylinder-drum-side receptacle for a cylinder-drum-side half-roller is formed. With finger-shaped protrusions of this type, it becomes easily possible to locate the two half-rollers of the roller pair for the transmission of the drive torque between the cylinder drum and the drive shaft.

In one particularly advantageous development of the invention, the drive shaft or the drive flange or the component which is connected in a torque-proof manner with the drive shaft is provided with at least one pocket-shaped recess in which the driver element is engaged with a finger-shaped protrusion. A drive-shaft-side receptacle for a drive-shaft-side half-roller is located in each pocket-shaped recess. The finger-shaped protrusions on the driver element or on the cylinder drum are each engaged in a pocket-shaped drive shaft-side recess, which results in a compact arrangement of the driving joint in the form of a cone-beam semi-roller joint between the drive shaft and the cylinder drum.

In one advantageous development of the invention, a spherical guide is located between the drive shaft and the cylinder drum. With a spherical guide, which is formed by a spherical segment on the drive shaft and a segment in the shape of a hollow sphere on the cylinder drum or on the sleeve-shaped driver element, it becomes easily possible on an axial piston machine with a torque transfer capability to center and support the cylinder drum. If the driving joint with the roller pairs is located in the vicinity of the spherical guide, a compact construction of the axial piston machine becomes possible.

In one preferred embodiment of the invention, the cylinder drum is provided with a longitudinal bore that is concentric with the axis of rotation of the cylinder drum and through which the drive shaft provided with the drive flange extends through the cylinder drum. The driving joint, which is in the form of a cone-beam semi-roller joint between the drive shaft and the cylinder drum, makes it possible, in connection with the spherical guide between the drive shaft and the cylinder drum, to provide the cylinder drum with a longitudinal bore which is concentric with the axis of rotation of the cylinder drum and through which the drive shaft can be routed to achieve a torque transfer capability on the axial piston machine.

The sleeve-shaped driver element is advantageously located in a torque-proof manner in the longitudinal bore of the cylinder drum. The drive shaft therefore also extends through the sleeve-shaped driver element.

In one advantageous development of the invention, for the transfer of torque, the drive shaft is provided with torque transmission means on both ends. This measure makes possible the universal use of the axial piston machine, in which a torque can be tapped on both sides of the drive shaft or a torque for the drive of an additional consumer can be transferred through the axial piston machine.

In one advantageous development of the invention, the drive shaft is a hollow shaft routed through a torque transfer shaft that extends through the axial piston machine. This arrangement makes possible a universal application of the axial piston machine. Different torques with different speeds of rotation and/or different directions of rotation can be present on the drive shaft and on the torque transfer shaft that runs through the drive shaft, which is itself in the form of a hollow shaft.

In one embodiment of the invention, the drive shaft can be mounted in a housing of the axial piston machine on one side in the vicinity of the drive flange. This arrangement results in a cantilevered mounting of the drive flange.

In one preferred development of the invention, the drive shaft is mounted in a housing of the axial piston machine on both sides of the cylinder drum. This achieves a broad bearing base for the drive shaft, as a result of which a compact length of the axial piston machine becomes possible, compared to a unilateral cantilever mounting of the drive shaft provided with the drive flange. A bilateral mounting of the drive shaft also has advantages with a drive shaft that is routed through the axial piston machine.

In one embodiment of the invention, the midpoints of the articulated joints of the pistons with the drive flange can be located in the longitudinal direction of the cylinder drum outside the cylinder drum. During a rotation of the cylinder drum, therefore, the articulated joints of the pistons with the drive flange are outside the longitudinal extent of the cylinder drum.

Additional advantages with reference to a compact length of the axial piston machines of the invention are achieved if, as in one development of the invention, the midpoints of the articulated joints of the pistons with the drive flange are located at least partly inside the cylinder drum in the longitudinal direction of the cylinder drum. During rotation of the cylinder drum the articulated joints of the pistons with the drive flange are at least partly inside the longitudinal extension of the cylinder drum. This measure results in a particularly short length of the axial piston machine in the axial direction. This mode of construction also makes it possible to achieve an enlarged open space between the drive shaft and the cylinder drum so that the pivoting angle of the cylinder drum can be increased and an increase in the power density of the axial piston machine becomes possible, and/or to increase the diameter of the drive shaft to achieve an increase in the transferred torque.

The axial piston machine can be a constant displacement machine with a fixed displacement volume.

On the driving joint, which is in the form of a cone-beam semi-roller joint, which can be easily realized in the form of a constant velocity joint, for the drive of the cylinder drum, a variation of the pivoting angle, i.e., of the axes of rotation of the drive shaft and the cylinder drum with respect to each other, is also possible. The driving joint in the form of the cone-beam semi-roller joint is suitable for use in a variable displacement machine with a variable displacement volume. The driving joint has the additional advantage that in the event of a decrease of the pivoting angle by a reverse pivoting of the cylinder drum, no play, with the associated disadvantages, results as it does on the axial piston machines utilizing a bent-axis construction of the prior art where the cylinder drum is driven by means of connecting rods or pistons.

BRIEF DESCRIPTION OF THE DRAWINGS

Additional advantages and details of the invention are described in greater detail below with reference to the exemplary embodiments illustrated in the accompanying schematic figures, in which like reference numbers identify like parts throughout.

DESCRIPTION OF THE PREFERRED EMBODIMENTS

Figure 1:
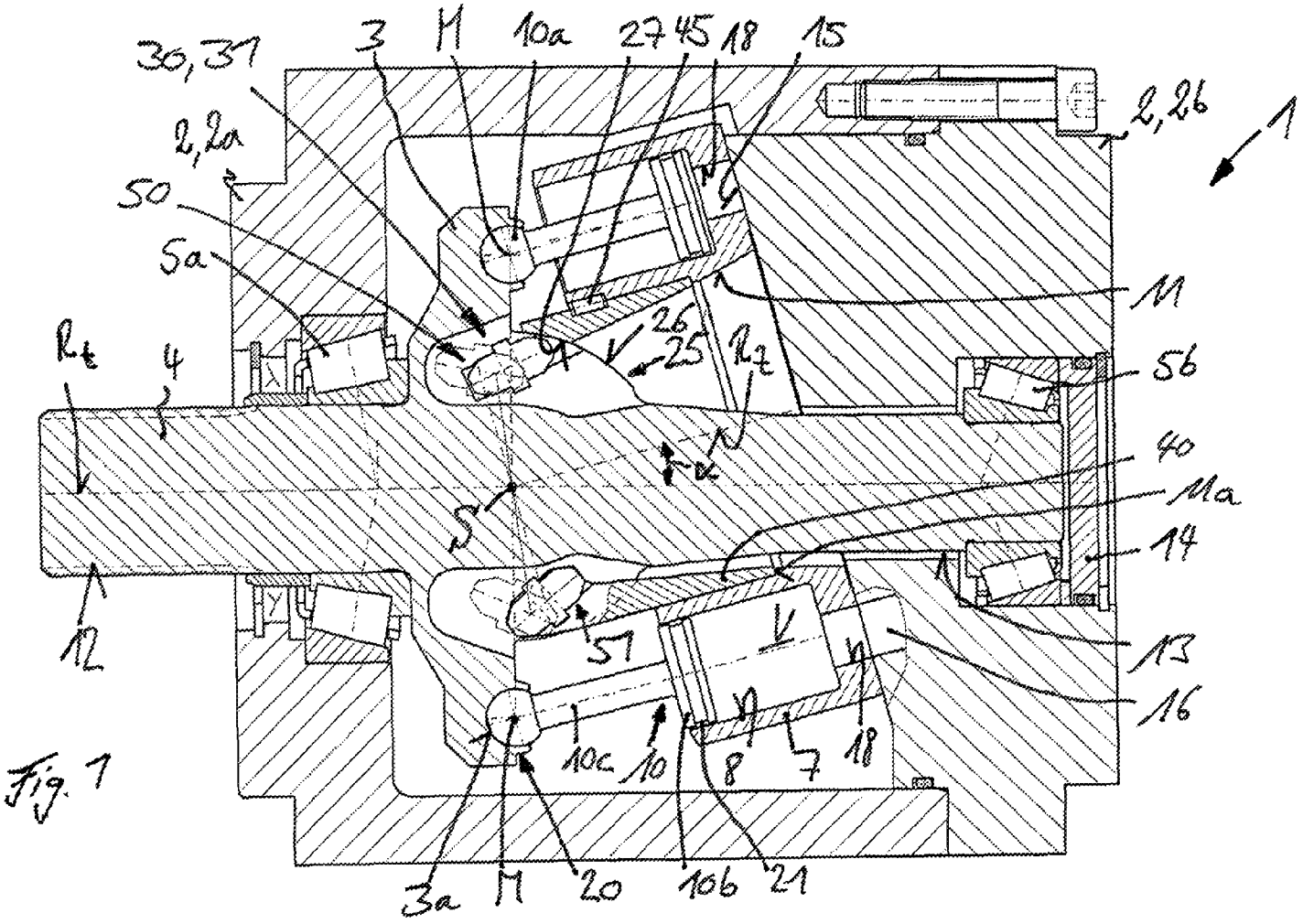
FIG. 1 is a longitudinal section of a first exemplary embodiment of a bent-axis machine of the invention.

The hydrostatic axial piston machine 1 in the form of a bent-axis machine illustrated in FIG. 1 has a housing 2, which includes a housing pot 2*a* and a housing cover 2*b*. In the housing 2, a drive shaft 4 provided with the drive flange 3 is rotationally mounted by bearings 5*a*, 5*b* so that it can rotate around an axis of rotation $R_t$. In the illustrated exemplary embodiment, the drive flange 3 is formed in one piece with the drive shaft 4.

Located axially next to the drive flange 3 in the housing 2 is a cylinder drum 7 which is provided with a plurality of piston bores 8, which are arranged concentrically to an axis of rotation $R_z$ of the cylinder drum 7. In each piston bore 8, there is a longitudinally displaceable piston 10.

The axis of rotation $R_t$ of the drive shaft 4 intersects the axis of rotation $R_z$ of the cylinder drum 7 at the intersection point S.

The cylinder drum 7 is provided with a central longitudinal bore 11 which is concentric with the axis of rotation $R_z$ of the cylinder drum 7, and through which bore the drive shaft 4 extends. The drive shaft 4 routed through the axial piston machine 1 is supported by the bearings 5*a*, 5*b*, on both sides (bilateral) of the cylinder drum 7. The drive shaft 4 is supported by the bearing 5*a* in the housing pot 2*a* and by the bearing 5*b* in the housing cover 2*b*.

The drive shaft 4 is provided on the drive flange side end with torque transmission means 12, such as splined gear teeth, for example, to transmit a drive torque or to tap an output torque. The opposite, cylinder-drum-side end of the drive shaft that extends through the axial piston machine 1 can also be provided with torque transmission means to make possible a transfer of torque through the axial piston machine 1. With the transfer, a torque can be transferred through the axial piston machine 1 or, on an axial piston machine 1 in the form of a hydraulic motor, can make possible a bilateral output of torque. There is a through hole 13 in the housing cover 2*b* for the drive shaft 4 which, in the illustrated exemplary embodiment, is closed by a cover 14.

The axial piston machine illustrated in FIG. 1 is a constant displacement machine with a fixed displacement volume. The axis of rotation $R_z$ of the cylinder drum 7 is at a constant angle of inclination or pivot angle $\alpha$ with respect to the axis of rotation $R_t$ of the drive shaft 4.

For control of the feed and discharge of hydraulic fluid in the displacement chambers V formed by the piston bores 8 and the pistons 10, the cylinder drum 7 is in contact with a control surface 15 formed on the housing cover 2*b* the control surface is provided with kidney-shaped control bores (not illustrated in detail) and form an admission connection 16 and a discharge connection of the axial piston machine 1. For the connection of the displacement chambers V formed by the piston bores 8 and the pistons 10 with the control bores located in the housing cover 2*b*, the cylinder drum 7 is provided with a control opening 18 at each piston bore 8.

The pistons 10 are each fastened to the drive flange 3 in an articulated manner. Between each piston 10 and the drive flange 3 there is an articulated joint 20 in the form of a spherical link. In the illustrated exemplary embodiment, the articulated joint 20 is in the form of a ball-and-socket joint formed by a spherical head 10*a* of the piston 10 and a spherical shell 3*a* in the drive flange 3 in which the piston 10 is fastened with the spherical head 10*a*.

The pistons 10 each have a collar segment 10*b*, by means of which the piston 10 is located in the piston bore 8. A piston rod 10*c* of the piston 10 connects the collar segment 10*b* with the spherical head 10*a*.

To make possible a compensating movement of the pistons 10 during rotation of the cylindrical drum 7, the collar segment 10*b* of the piston 10 is located in the piston bore 8 with some clearance or play. The collar segment 10*b* of the piston 10 can be spherical. To create a seal between the pistons 10 and the piston bores 8, sealing means 21, such as a piston ring, for example, are located on the collar segment 10*b* of the piston 10.

For bearing and centering of the cylinder drum 7, there is a spherical guide 25 between the cylinder drum 7 and the drive shaft 4. The spherical guide 25 is formed by a spherical segment 26 of the drive shaft 4 on which is located the cylinder drum 7 with a segment 27 in the shape of a hollow sphere in the vicinity of the central longitudinal bore 11. The midpoint of the segments 26, 27 lies at the intersection S of the axis of rotation $R_t$ of the drive shaft 4 and the axis of rotation of the cylinder drum 7.

On the axial piston machine 1 illustrated in FIG. 1, the midpoints M of the articulated joints 20 of the pistons 10 with the drive flange 3 in the longitudinal direction of the cylinder drum 7 are located completely outside the cylinder drum 7. The midpoints M of the articulated joints 20 are therefore always outside the longitudinal extension of the cylinder drum 7 during a rotation of the cylinder drum 7.

To drive the cylinder drum 7 during operation of the axial piston machine 1, between the drive shaft 4 of the cylinder drum 7 there is a driving joint 30 that couples the drive shaft 4 and the cylinder drum 7 in their direction of rotation. The driving joint 30 is a constant velocity joint, which makes possible a rotationally synchronous drive of the cylinder drum 7 with the drive shaft 4, resulting in a uniform, synchronous rotation of the cylinder drum 7 with the drive shaft 4.

The invention teaches that the driving joint 30 is a cone-beam semi-roller joint 31.

The construction of the cone-beam semi-roller joint 31 with which the cylinder drum 7 and the drive shaft 4 are rotationally synchronously coupled is explained in greater detail below with reference to FIGS. 2 to 4 and 8 to 13.

The cone-beam semi-roller joint 31 is formed by a plurality of roller pairs 50, 51, 52, 53, located between the drive shaft 4 and a sleeve-shaped driver element 40 which is connected in a torque-proof manner with the cylinder drum 7.

The sleeve-shaped driver element 40 is located in the central longitudinal bore 11 of the cylinder drum 7. The driver element 40 is secured to the cylinder drum 7 in the longitudinal direction of the cylinder drum 7, in the axial direction, and in the peripheral direction. For axial securing, the driver element 40 is in contact with an end surface on a diametric shoulder 11*a* of the longitudinal bore 11. The driver element 40 is held in a torque-proof manner by securing means 45, which in the illustrated exemplary embodiment are formed by a connecting pin located between the sleeve-shaped driver element 40 and the cylinder drum 7. The drive shaft 4 routed through the axial piston machine 1 likewise extends through the sleeve-shaped driver element 40.

Figure 10:
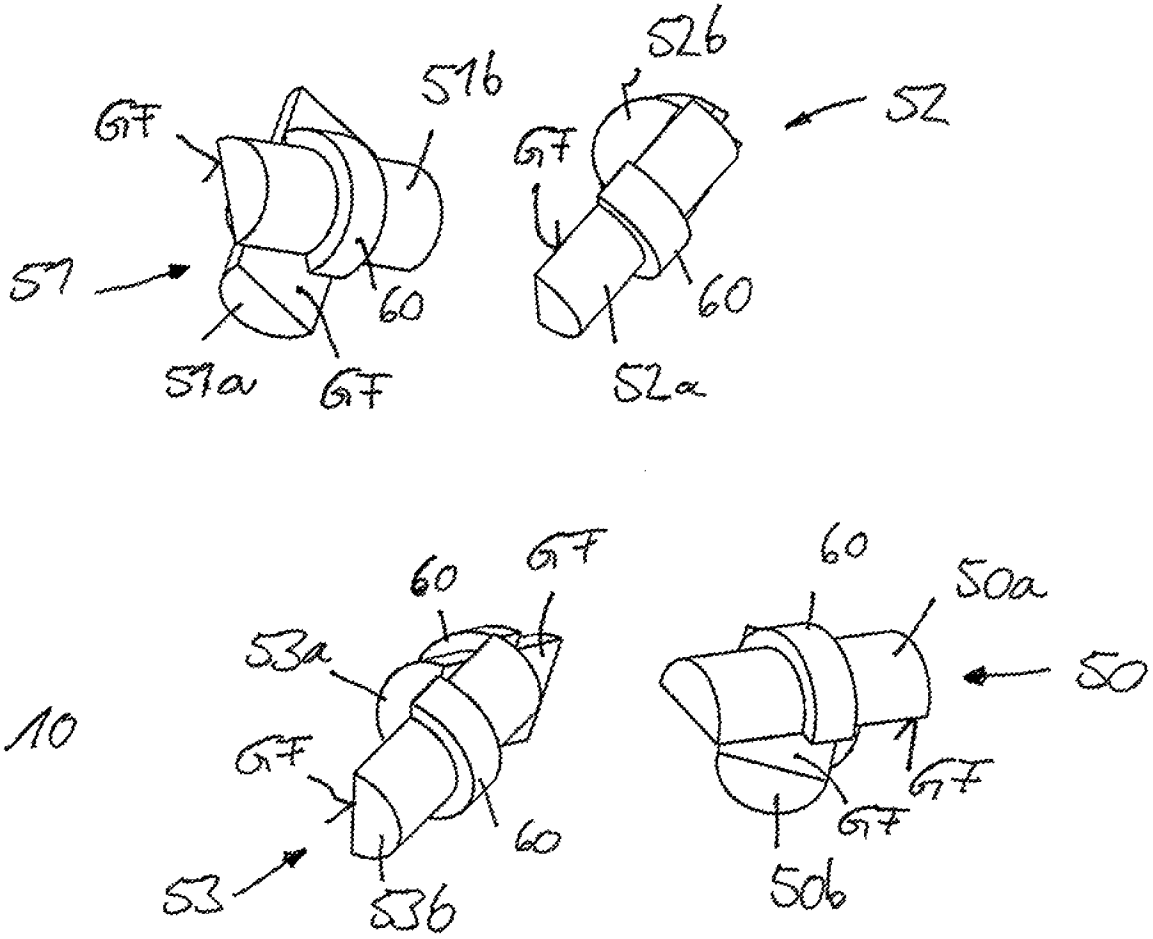
FIG. 10 is an illustration of the roller pairs in FIGS. 8 and 9.
Figure 11:
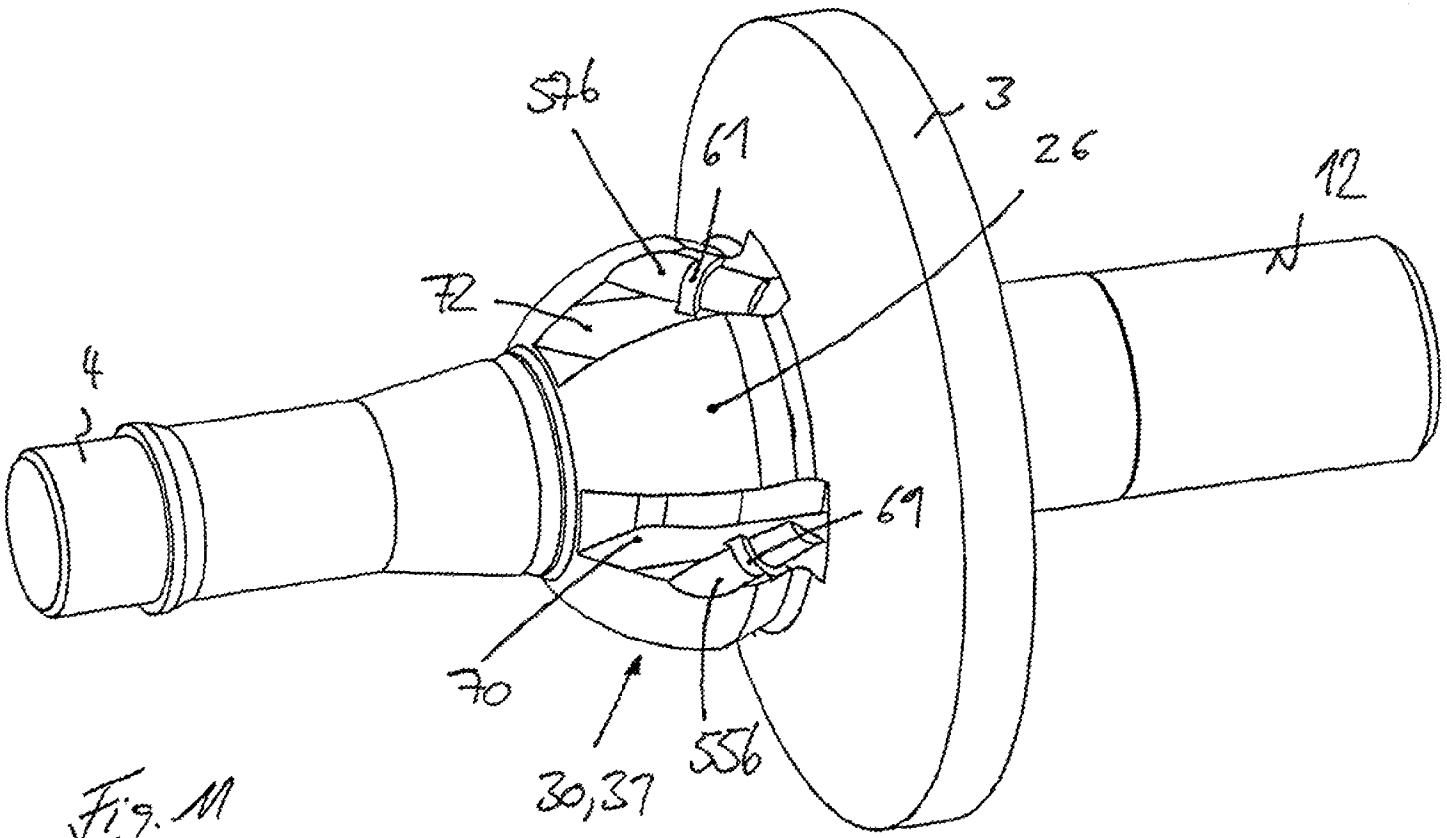
FIG. 11 illustrates the drive shaft of the driving joint of the invention in a three-dimensional representation.
Figure 12:
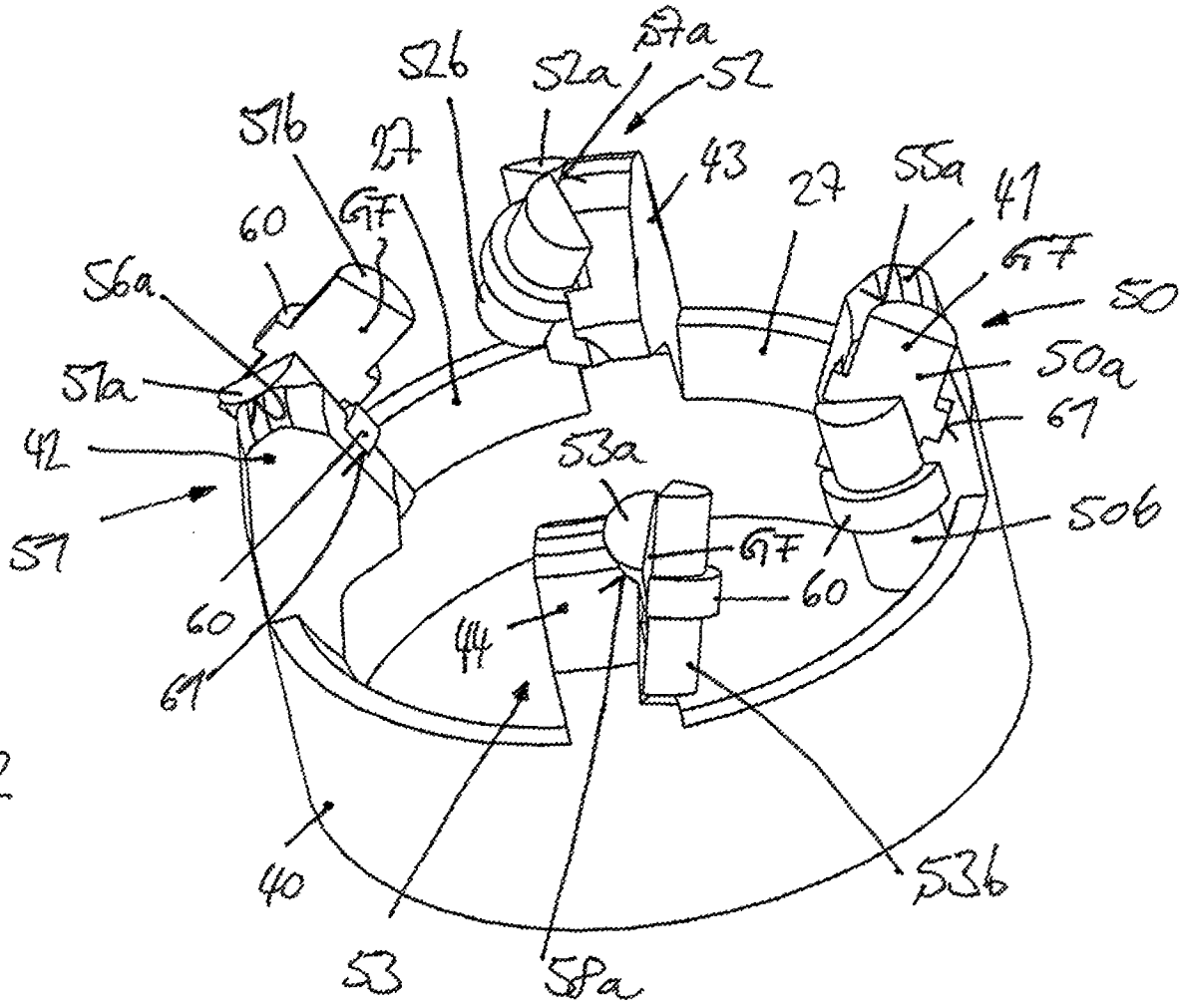
FIG. 12 illustrates the cylinder drum of the driving joint of the invention with the roller pairs in a three-dimensional representation.
Figure 13:
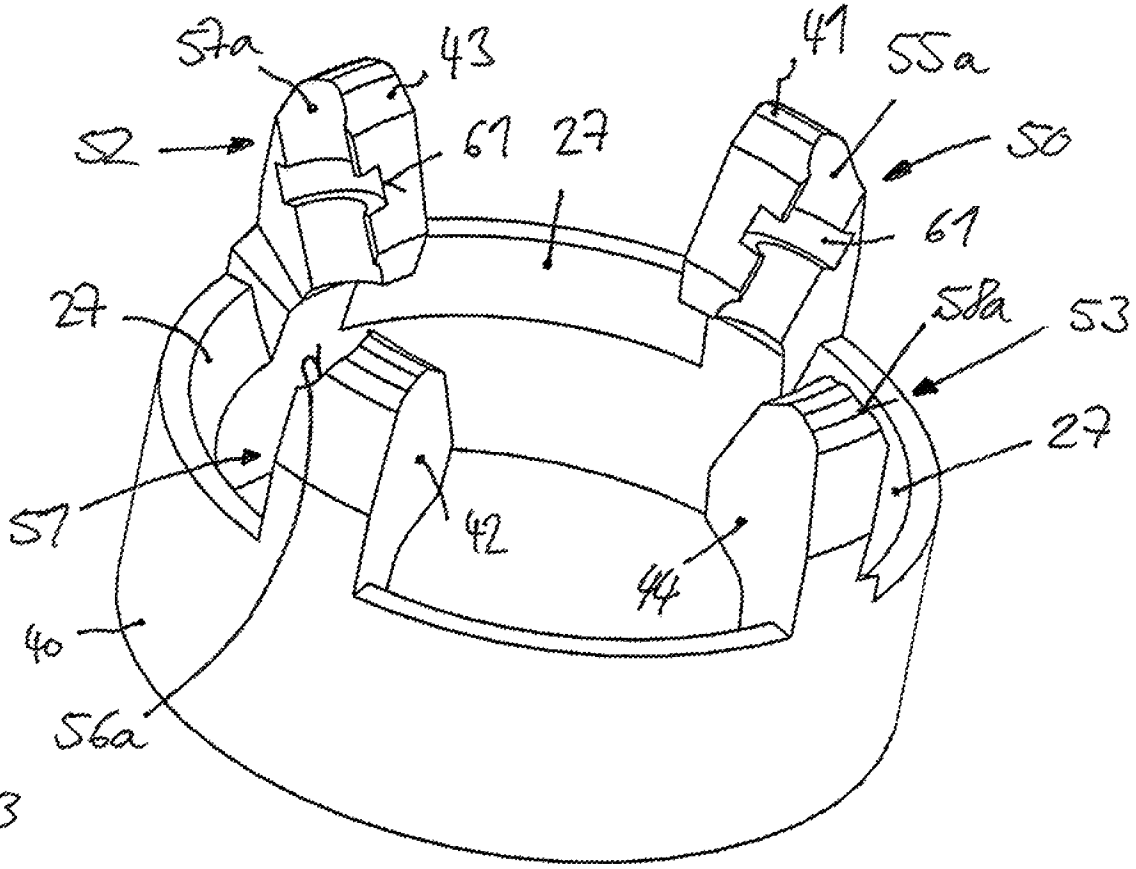
FIG. 13 is a view as in FIG. 12 without the roller pairs of the driving joint of the invention.
Figure 14:
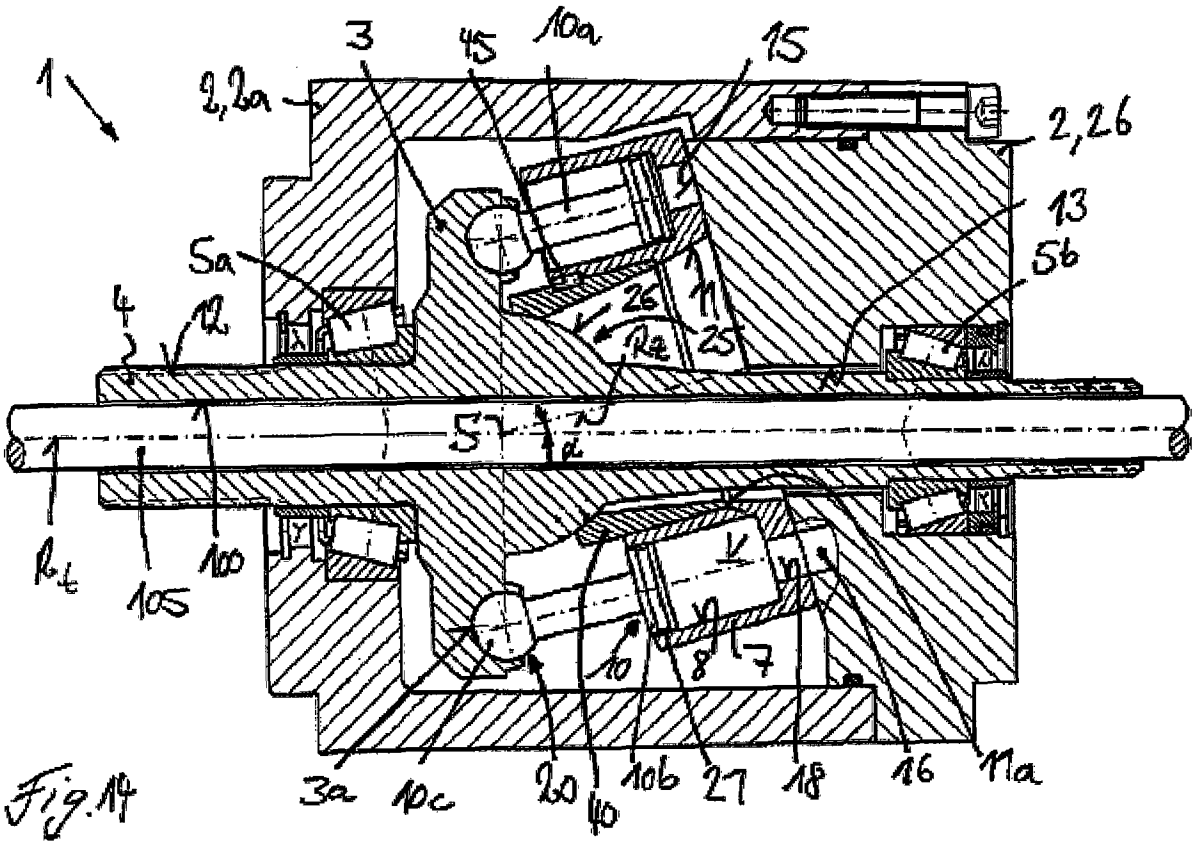
FIG. 14 is a longitudinal section view of the bent-axis machine of FIG. 1 including a hollow drive shaft.

Each of the plurality of roller pairs 50-53 of the cone-beam semi-roller joint 31 includes two semi-cylindrical half-rollers 50*a*, 50*b*, 51*a*, 51*b*, 52*a*, 52*b*, 53*a*, 53*b*, which thus form pairs. The semi-cylindrical half-rollers 50*a*, 50*b*, 51*a*, 51*b*, 52*a*, 52*b*, 53*a*, 53*b* (as indicated in FIG. 10) are each cylindrical bodies flattened along an axis of rotation $RR_t$, $RR_z$. On the flat sides, the half-rollers 50*a*, 50*b*, 51*a*, 51*b*, 52*a*, 52*b*, 53*a*, 53*b* form planar sliding surfaces GF on which the two half-rollers 50*a*, 50*b*, 51*a*, 51*b*, 52*a*, 52*b*, 53*a*, 53*b* of a roller pair 50, 51, 52, 53 are in contact with each other.

The half-rollers 50*a*, 50*b*, 51*a*, 51*b*, 52*a*, 52*b*, 53*a*, 53*b* are located in the radial direction inside the reference circle of the piston 10 and at a distance from the axes of rotation $R_t$, $R_z$. The cone-beam semi-roller joint 31 can be located compactly inside the reference circle of the pistons 10.

Each roller pair 50-53 has one cylinder-drum-side half-roller 50*a*, 51*a*, 52*a*, 53*a* that belongs to or is associated with the cylinder drum 7 and one drive shaft-side roller 50*b*, 51*b*, 52*b*, 53*b* that belongs to or is associated with the drive shaft 4, which are in contact with each other at the planar sliding surfaces GF.

The cylinder-drum-side half-rollers 50*a*, 51*a*, 52*a*, 53*a* of the corresponding roller pair 50-53 are each located in a cylindrical, in particular partly cylindrical, cylinder-drum-side receptacle 55*a*, 56*a*, 57*a*, 58*a* and the drive-shaft-side half rollers 50*b*, 51*b*, 52*b*, 53*b* of a roller pair 50-53 are each located in a cylindrical, in particular partly cylindrical, drive-shaft-side receptacle 55*b*, 56*b*, 57*b*, 58*b*.

The half-rollers 50*a*, 50*b*, 51*a*, 51*b*, 52*a*, 52*b*, 53*a*, 53*b* are each secured in the respective cylindrical receptacles 55*a*, 56*a*, 57*a*, 58*a*, 55*b*, 56*b*, 57*b*, 58*b* in the longitudinal direction of the corresponding axis of rotation.

Each half-roller 50*a*, 50*b*, 51*a*, 51*b*, 52*a*, 52*b*, 53*a*, 53*b* is provided in the cylindrical section with a collar 60 which is engaged in a groove 61 of the corresponding receptacle 55*a*, 56*a*, 57*a*, 58*a*, 55*b*, 56*b*, 57*b*, 58*b*.

Figure 2:
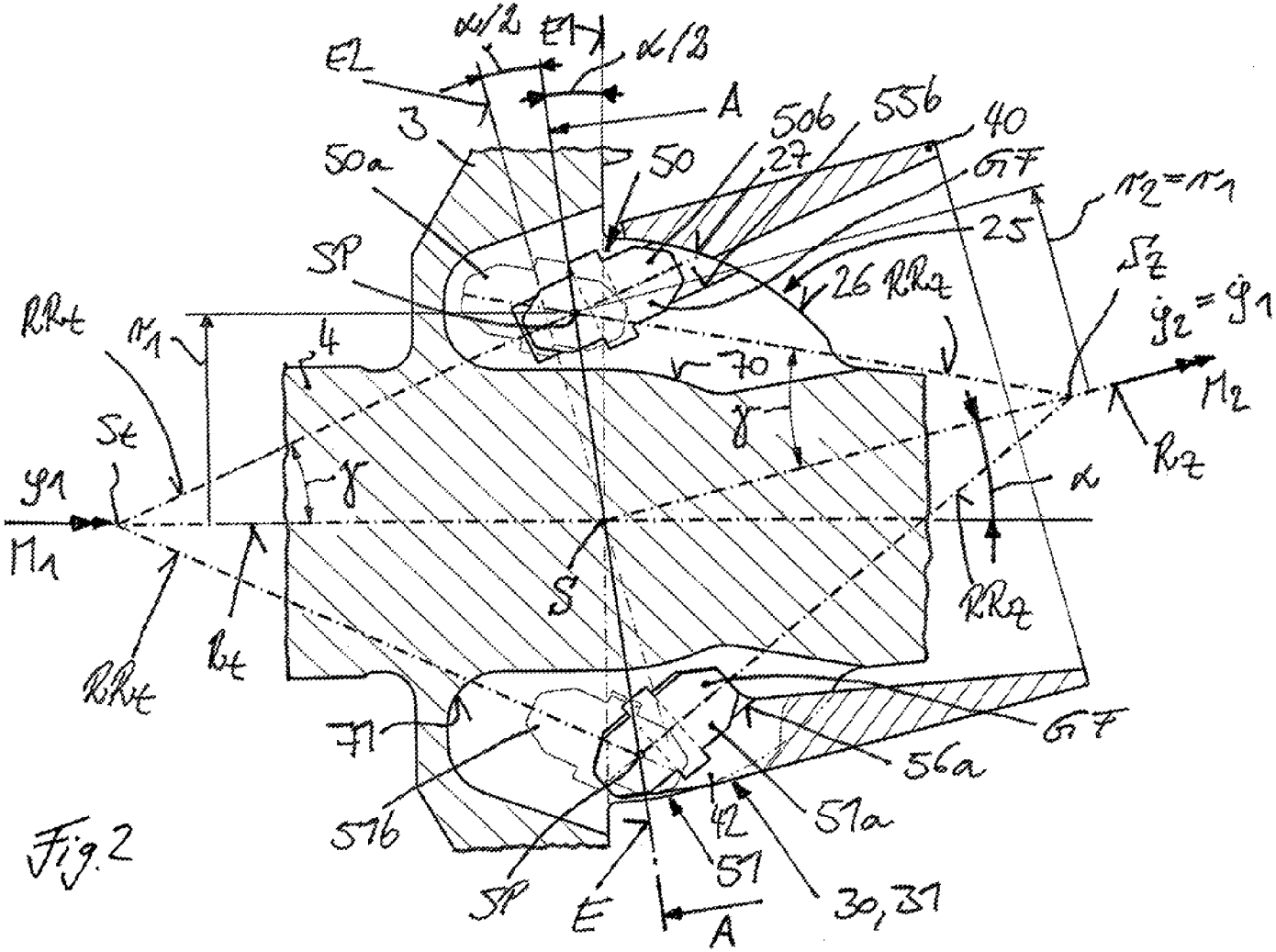
FIG. 2 shows a detail of FIG. 1 in the vicinity of the driving joint of the invention.

In FIG. 2, the drive-shaft-side half-roller 50*b* of the roller pair 50 is drawn in thick lines and the cylinder-drum-side half-roller 50*a* that is in contact with the half-roller 50*b* is drawn in thin lines. The cylinder-drum-side half-roller 51*a* of the roller pair 51 is drawn in thick lines and the drive-shaft-side half-roller 51*b* that is in contact with the half-roller 51*a* is drawn in thin lines. The flattened, planar, sliding surfaces GF of the half-rollers 50*b* and 51*a* that lie in the plane of the section in FIG. 2 are illustrated.

In the cone-beam semi-roller joint 31 (as illustrated in FIG. 2) the axes of rotation $RR_t$ of the drive-shaft-side half-rollers 50*b*, 51*b*, 52*b*, 53*b* are inclined at an angle of inclination $\gamma$ with respect to the axis of rotation $R_t$ of the drive shaft 4. The axes of rotation $RR_t$ of the drive-shaft-side half-rollers 50*b*, 51*b*, 52*b*, 53*b* intersect the axis of rotation $R_t$ of the drive shaft 4 at the point of intersection $S_t$. The individual axes of rotation $RR_t$ of the plurality of drive-shaft-side half-rollers 50*b*, 51*b*, 52*b*, 53*b* form a cone-beam, illustrated in FIG. 2, around the axis of rotation $R_t$ of the drive shaft 4 with the apex located at the point of intersection $S_t$.

The axes of rotation $RR_z$ of the cylinder-drum-side half-rollers 50*a*, 51*a*, 52*a*, 53*a* are correspondingly inclined at an angle of inclination $\gamma$ with reference to the axis of rotation $R_z$ of the cylinder drum 7. The axes of rotation $RR_z$ of the cylinder-drum-side half-rollers 50*a*, 51*a*, 52*a*, 53*a* intersect the axis of rotation $R_z$ of the cylinder drum 7 at the point of intersection $S_z$. The individual axes of rotation $RR_z$ of the plurality of cylinder-drum-side half-rollers 50*a*, 51*a*, 52*a*, 53*a* form a cone-beam illustrated in FIG. 2 around the axis of rotation $R_z$ of the cylinder drum 7, with the apex located at the point of intersection $S_z$.

The angles of inclination $\gamma$ of the axes of rotation $RR_z$ of the cylinder-drum-side half-rollers 50*a*, 51*a*, 52*a*, 53*a* with respect to the axis of rotation $R_z$ of the cylinder drum 7 and the axes of rotation $RR_t$ of the drive shaft side half-rollers 50*b*, 51*b*, 52*b*, 53*b* with respect to the axis of rotation $R_t$ of the drive shaft 4 are identical. The angles of inclination $\gamma$ of the axes of rotation $RR_z$, $RR_t$ of the half-rollers of the drive shaft 4 and cylinder drum 7 to be coupled to each other are therefore equal. Consequently, on the corresponding roller pairs 50-53, the axes of rotation $RR_t$ that belong to the drive shaft 4 and the axes of rotation $RR_z$ that belong to the cylinder drum 7 of the two half-rollers that form a roller pair intersect in pairs in a plane E which corresponds to the line bisecting the angle between the axis of rotation $R_t$ of the drive shaft 4 and the axis of rotation $R_z$ of the cylinder drum 7. The points of intersection SP that lie in the plane E, in which the respective axes of rotation $RR_t$ belonging to the drive shaft 4 intersect in pairs with the axis of rotation $RR_z$ belonging to the cylinder drum 7 of the two half-rollers that form a roller pair are illustrated in FIG. 2. The plane E is therefore inclined at one-half the angle of inclination or pivoting angle $\alpha/2$ with respect to a plane E1 which is perpendicular to the axis of rotation $R_t$ of the drive shaft 4 and a plane E2 which is perpendicular to the axis of rotation $R_z$ of the cylinder drum 7. The plane E passes through the point of intersection S of the axes of rotation $R_t$, $R_z$.

The half-rollers 50*a*, 50*b*, 51*a*, 51*b*, 52*a*, 52*b*, 53*a*, 53*b* of the respective roller pairs 50, 51, 52, 53 are located in the vicinity of the points of intersection SP of the axes of rotation $RR_t$, $RR_z$, as a result of which the transmission of force between planar sliding surfaces GF for the drive of the cylinder drum 7 takes place at the points of intersection SP of the two half-rollers of the respective roller pair 50-53.

On account of the position of the points of intersection SP of the two half-rollers of the respective roller pairs 50-53 in the plane E that bisects the angle, the perpendicular radial distances $r_1$, $r_2$ of the points of intersection SP from the axis of rotation $R_t$ of the drive shaft 4 and from the axis of rotation $R_z$ of the cylinder drum 7 are equal. On account of the equal lever arms formed by the radial distances $r_1$, $r_2$ of the points of intersection, there are equal angular velocities $\phi$1 of the drive shaft 4 and $\phi$2 of the cylinder drum 7, as a result of which the cone-beam semi-roller joint 31 forms a constant velocity joint which makes possible an exactly rotationally synchronous drive and rotation of the cylinder drum 7.

In operation of the axial piston machine 1, during rotation of the drive shaft 4, with an inclination of the axis of rotation $R_z$ of the cylinder drum 7 with respect to the axis of rotation $R_t$ of the drive shaft 4 at the angle of inclination or pivoting angle $\alpha$, a sliding of the two sliding surfaces GF of the two half-rollers of each roller pair 50-53 takes place. There is also a rotation of the respective semi-cylindrical half-roller around the respective axes of rotation $RR_t$ or $RR_z$ in the bed of the corresponding half-roller formed by the cylindrical receptacle 55*a*, 56*a*, 57*a*, 58*a*, 55*b*, 56*b*, 57*b*, 58*b*. On account of the inclination of the axes of rotation $RR_t$, $RR_z$ of the half-rollers 50*a*, 50*b*, 51*a*, 51*b*, 52*a*, 52*b*, 53*a*, 53*b* arranged in pairs with respect to one another, the planar surfaces and, thus, the sliding surfaces GF of the half-rollers in contact with each other can be oriented with respect to one another by rotation in the corresponding receptacles 55*a*, 56*a*, 57*a*, 58*a*, 55*b*, 56*b*, 57*b*, 58*b*.

The axial piston machine 1 illustrated in FIG. 1 can be operated in both directions of rotation. To achieve a rotationally synchronous drive of the cylinder drum 7 in both directions of rotation, at least one roller pair 50-53 is provided for each direction of rotation and, thus, for each direction of torque of the drive torque for the drive of the cylinder drum 7.

Figure 3:
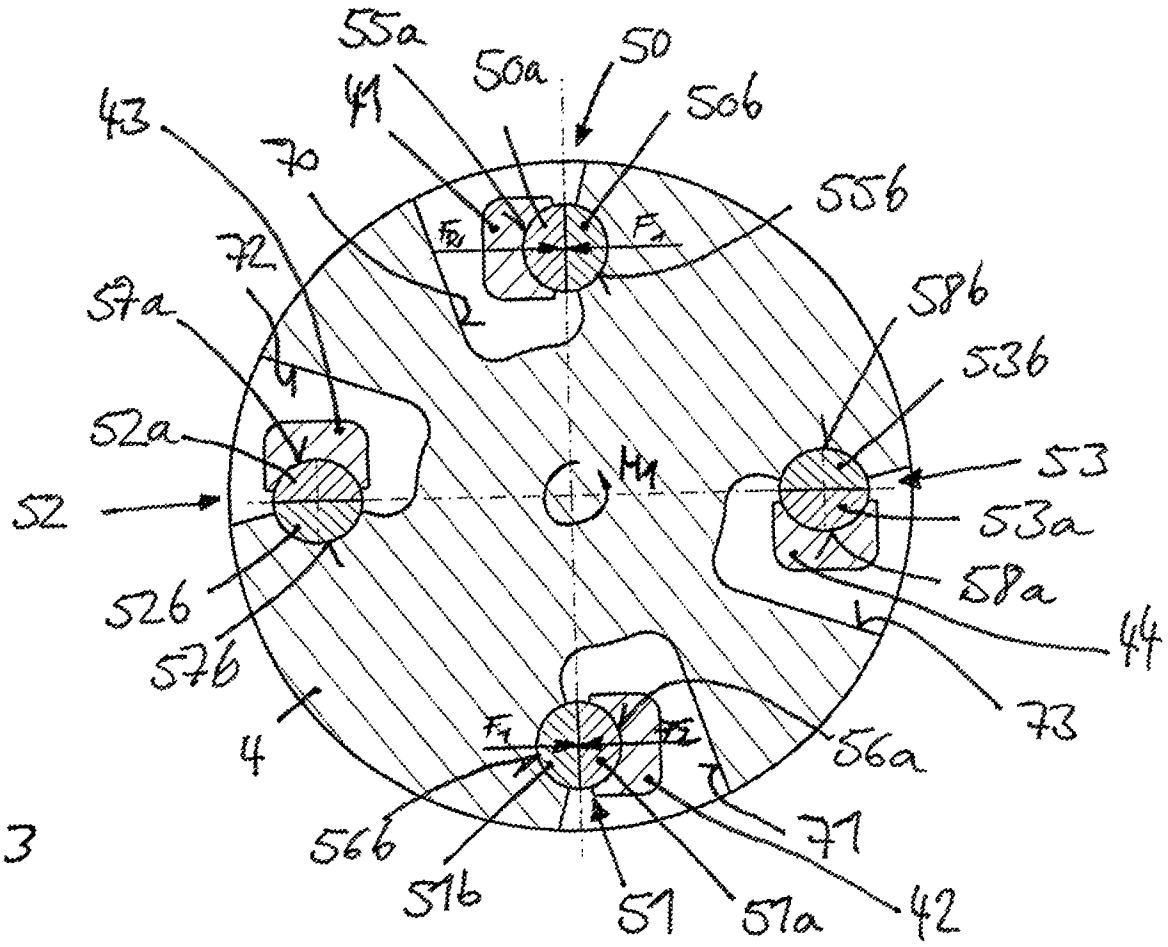
FIG. 3 shows a section along line A-A in FIG. 2 with the transmission forces that occur on the driving joint for a first direction of rotation.

In the illustrated embodiment, the roller pairs 50, 51 are used to drive the cylinder drum 7 during a rotation of the drive shaft 4 in the counterclockwise direction. FIG. 3 shows, for this direction of rotation of the drive shaft 4, the forces F1, F2 which are transmitted at the planar sliding surfaces GF of the half-rollers 50*a*, 50*b* and 51*a*, 51*b* of the roller pairs 50, 51, which generate the drive torque M2 for the drive of the cylinder drum 7. By means of the drive shaft 4, the torque M1 is applied, and the force F1 is applied at the drive-shaft-side half-rollers 50*b*, 51*b* which, by means of the force F2 that occurs on the cylinder-drum-side half-rollers 50*a*, 51*a*, generate the drive torque M2 for the drive of the cylinder drum 7.

Figure 4:
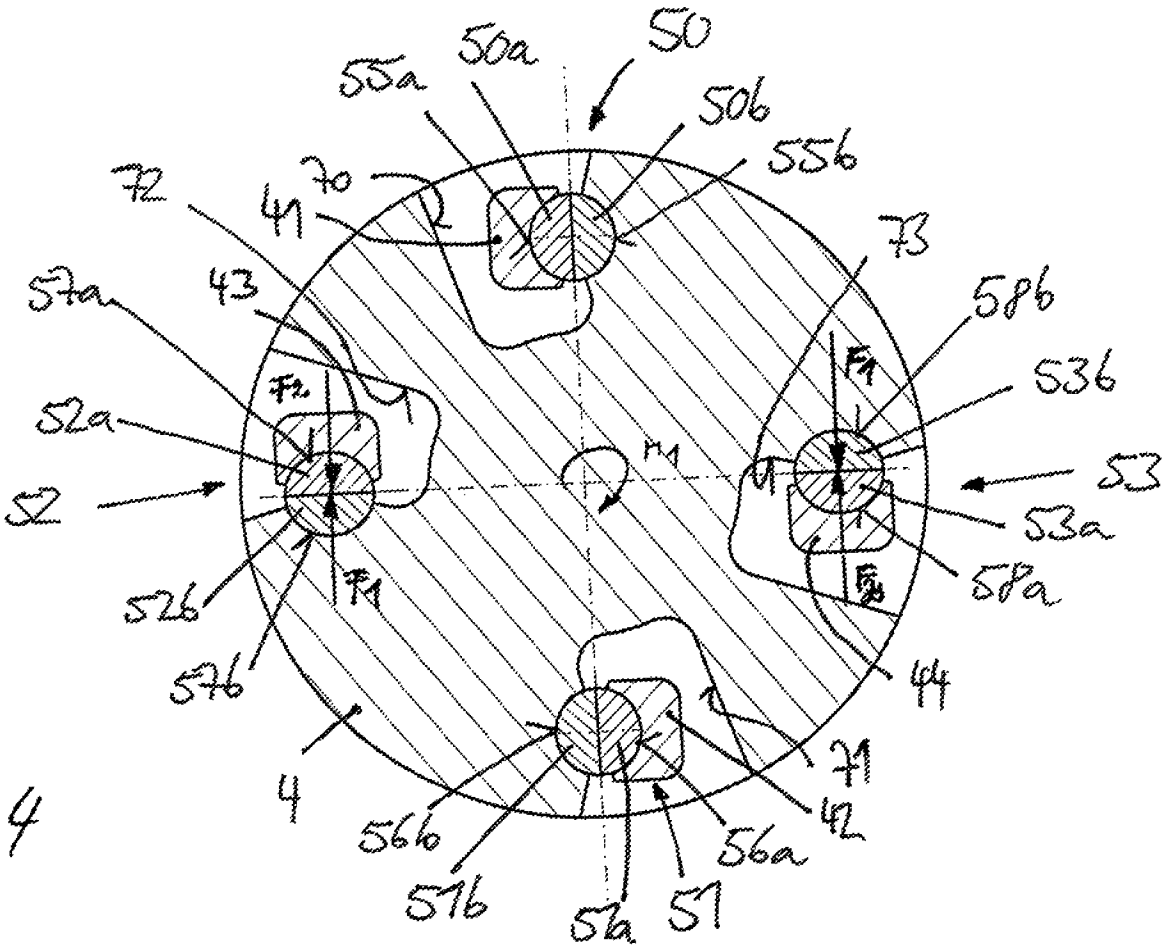
FIG. 4 shows a section along line A-A in FIG. 2 with the transmission forces that occur on the driving joint for a second, opposite direction of rotation.

In the illustrated exemplary embodiment, the roller pairs 52, 53 are used to drive the cylinder drum 7 in an opposite direction of rotation to the drive shaft 4 in the clockwise direction. FIG. 4 shows, for this direction of rotation of the drive shaft 4, the forces F1, F2 which are transmitted at the planar sliding surfaces GF of the half-rollers 52*a*, 52*b* and 53*a*, 53*b* of the roller pairs 52, 53 from the torque M1 acting on the drive shaft 4, which forces F1, F2 generate the drive torque M2 for the drive of the cylinder drum 7. By means of the drive shaft 4, the torque M1 is applied, and at the drive shaft side half-rollers 52*b*, 53*b* the force F1 is applied, which, by means of the force F2 that occurs on the cylinder-drum-side half-rollers 52*a*, 53*a*, generate the drive torque M2 for the drive of the cylinder drum 7.

In the illustrated exemplary embodiment, there are two roller pairs 50, 51 and 52, 53 for each direction of rotation, respectively. The roller pairs 50, 51 for the first direction of rotation and the roller pairs 52, 53 for the second direction of rotation are uniformly distributed over the periphery. This arrangement makes possible an equalization of the radial forces. In the illustrated exemplary embodiment with two roller pairs for each direction of rotation, the roller pairs 50, 51 are offset by a rotational angle of 180° and the roller pairs 52, 53 are offset by a rotational angle of 180°. The roller pairs 50, 51 for the first direction of rotation are offset from the roller pairs 52, 53 for the second direction of rotation by a rotational angle of 90°.

In the illustrated exemplary embodiment, the drive-shaft-side receptacles 55*b*, 56*b*, 57*b*, 58*b* for the drive shaft-side half-rollers 50*b*, 51*b*, 52*b*, 53*b* are located in the drive shaft 4. For this purpose, the drive shaft 4 is provided in the vicinity of the spherical segment 26 with pocket-shaped recesses 70, 71, 72, 73, on the side surfaces of each of which there is a drive-shaft-side receptacle 55*b*, 56*b*, 57*b*, 58*b*.

In the illustrated exemplary embodiment, the cylinder-drum-side receptacles 55*a*, 56*a*, 57*a*, 58*a* for the cylinder-drum-side half-rollers 50*a*, 51*a*, 52*a*, 53*a* are located in the sleeve-shaped driver element 40. The sleeve-shaped driver element 40 is provided with finger-shaped protrusions 41, 42, 43, 44, which extend toward the drive shaft 4 and in each of which there is a cylinder-drum-side receptacle 55*a*, 56*a*, 57*a*, 58*a*. The sleeve-shaped driver element 40 is also provided with the segment 27 in the form of a hollow sphere of the spherical guide 25.

Each finger-shaped protrusion 41, 42, 43, 44 of the driver element 40 is engaged in an associated pocket-shaped recess 70, 71, 72, 73 of the drive shaft 4.

In the axial piston machine 1 illustrated in FIG. 1, the roller pairs 50-53 of the cone-beam semi-roller joint 31 are located outside the cylinder drum 7 viewed in the longitudinal direction of the cylinder drum 7.

Figure 5:
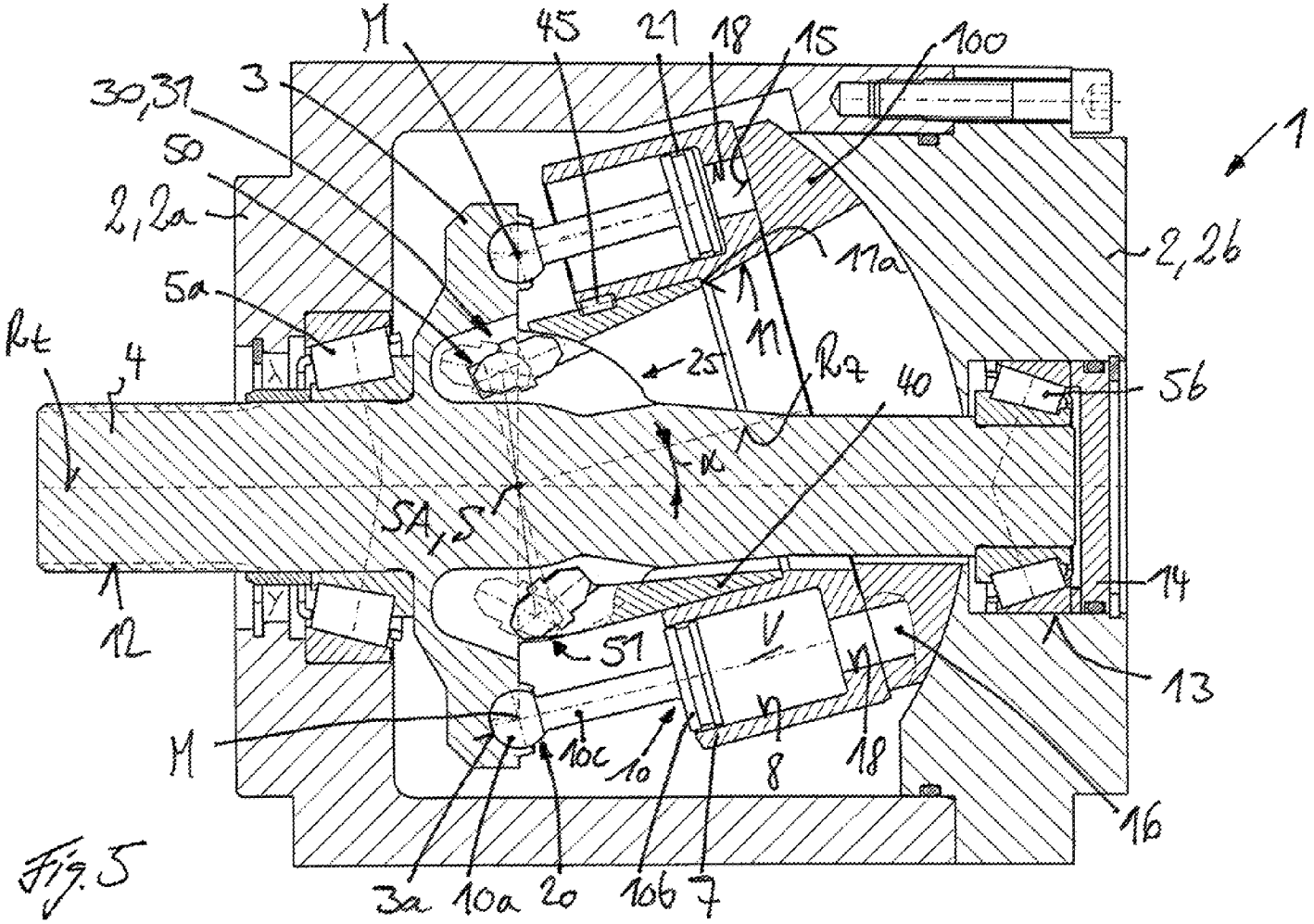
FIG. 5 is a longitudinal section of a second exemplary embodiment of a bent-axis machine of the invention.
Figure 6:
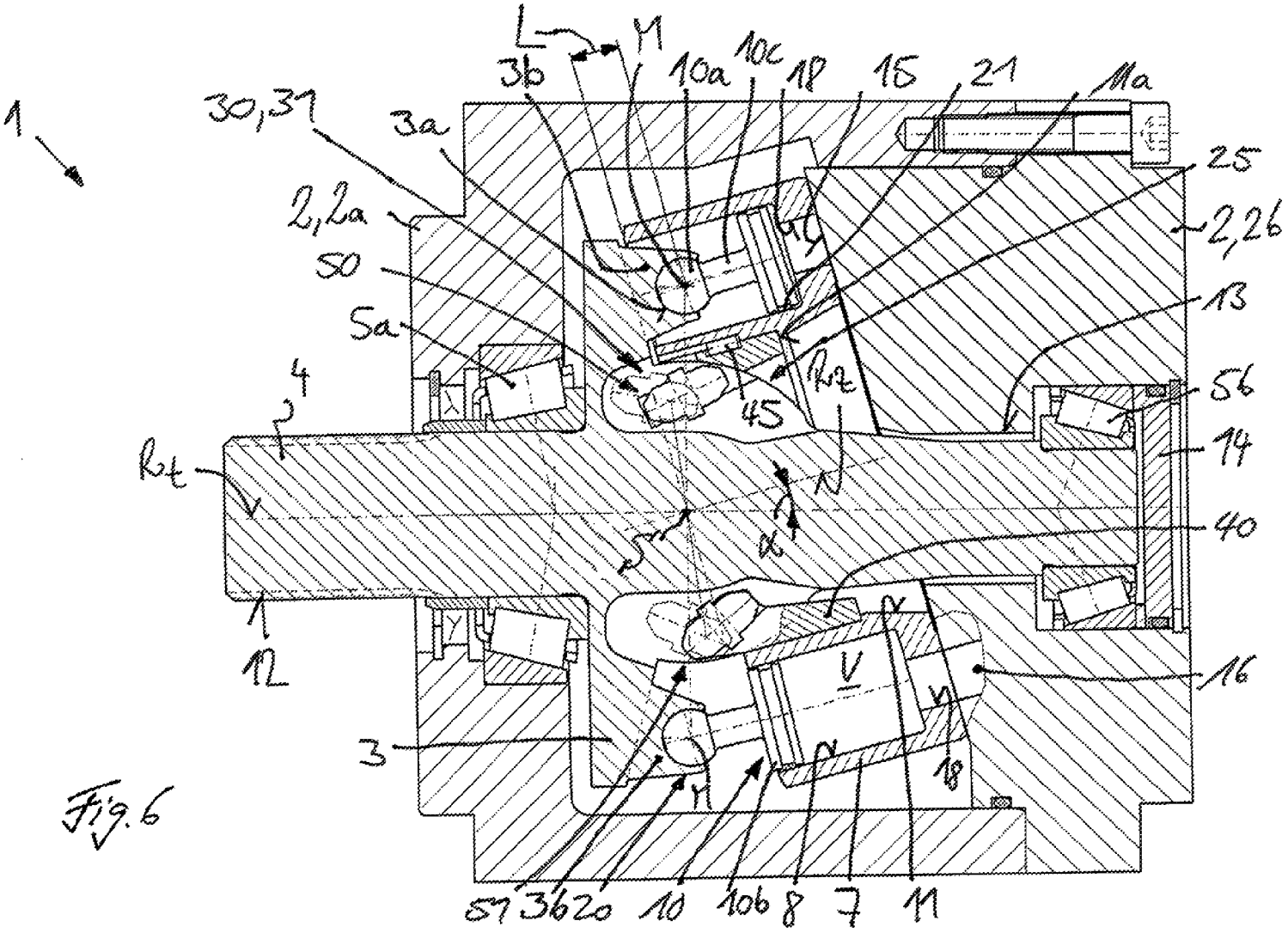
FIG. 6 is a longitudinal section of a third exemplary embodiment of a bent-axis machine of the invention.
Figure 7:
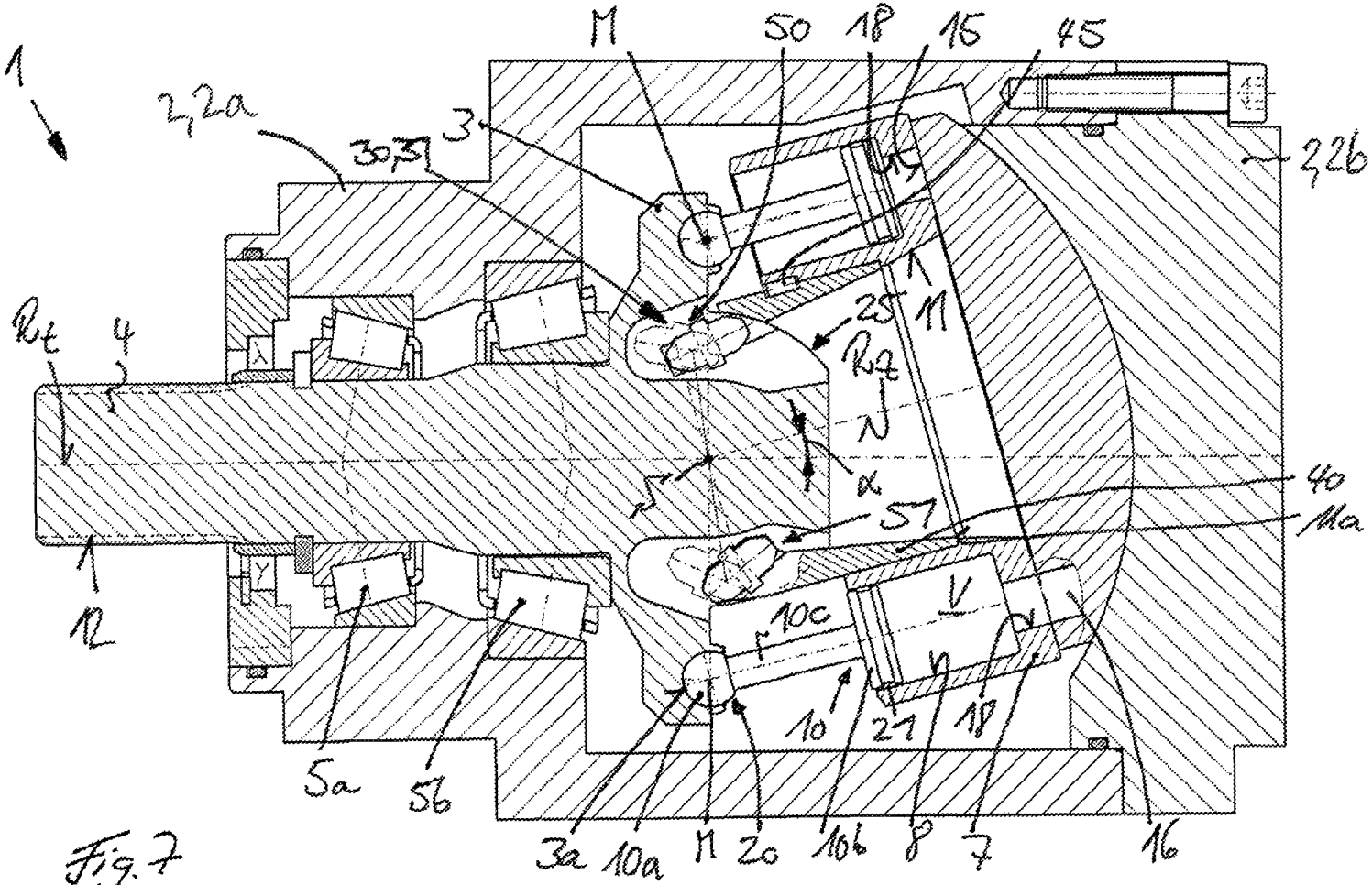
FIG. 7 is a longitudinal section of a fourth exemplary embodiment of a bent-axis machine of the invention.
Figure 8:
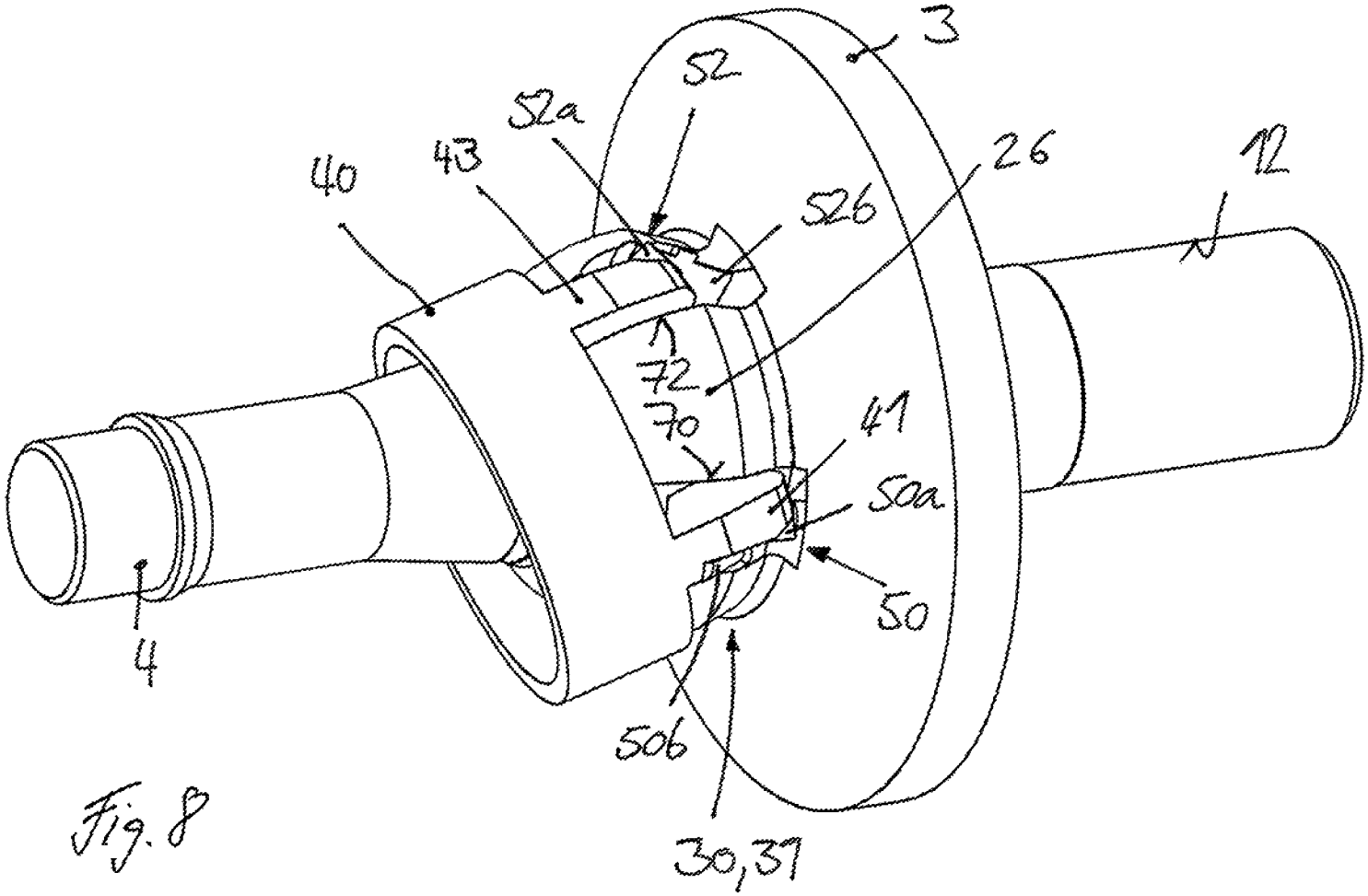
FIG. 8 shows the driving joint between the drive shaft and the driver element of the cylinder drum in a three-dimensional representation.
Figure 9:
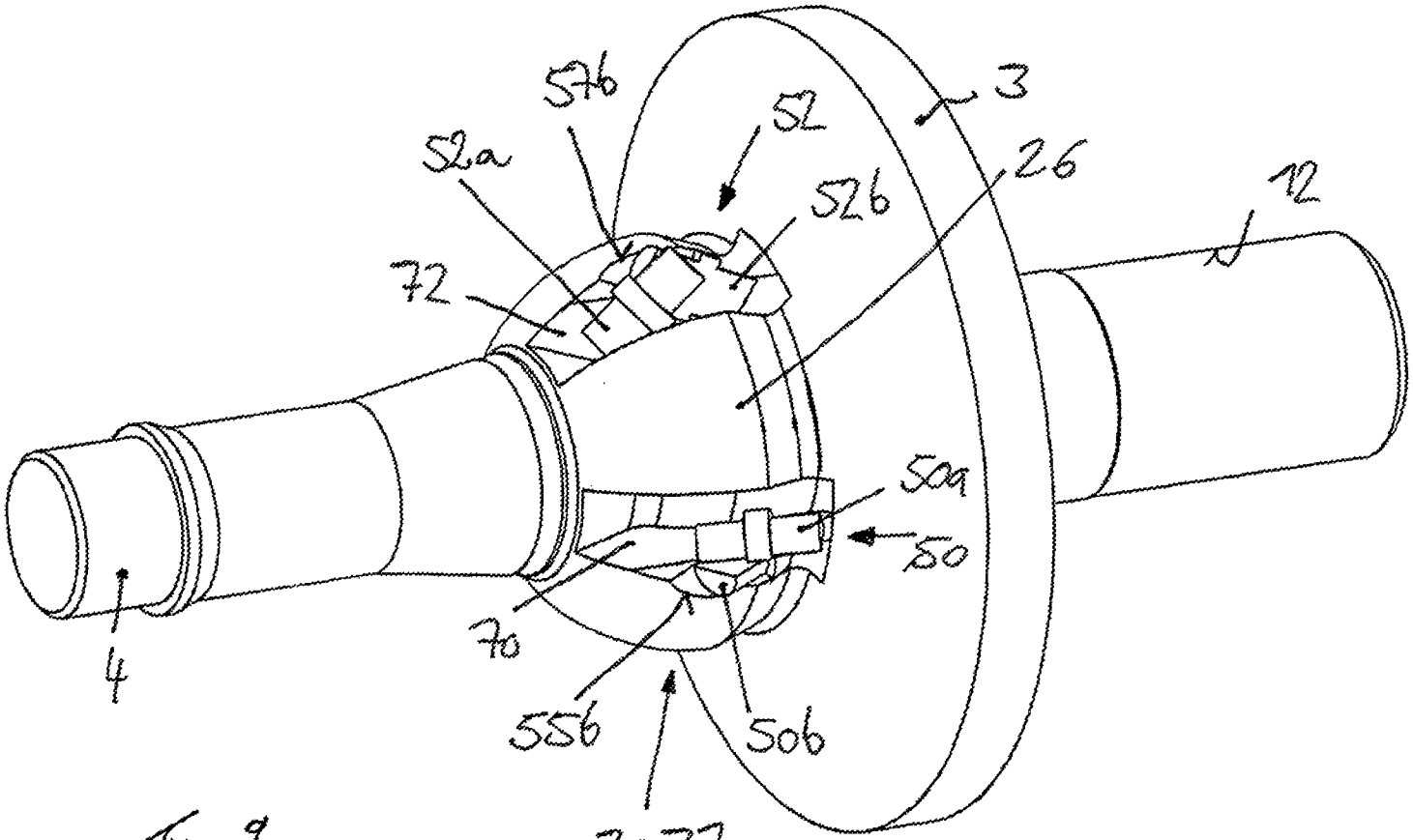
FIG. 9 is similar to FIG. 8 with the roller pairs of the driving joint with the cylinder drum removed.

FIGS. 5 to 7 illustrate additional exemplary embodiments of an axial piston machine claimed by the invention that employs a bent-axis construction, wherein components that are identical to those in FIG. 1 are identified by the same reference numbers. The exemplary embodiments illustrated in FIGS. 5 to 7 are the same as FIGS. 1 to 4 and 8 to 13 in terms of the construction of the cone-beam semi-roller joint 31 for the drive of the cylinder drum 7.

The axial piston machine 1 illustrated in FIG. 5 is a variable displacement machine with a variable displacement volume. On the variable displacement machine, the angle of inclination $\alpha$ of the axis of rotation $R_z$ of the cylinder drum 7 can be varied with respect to the axis of rotation $R_t$ of the drive shaft 4 to vary the displacement volume. The control surface 15 with which the cylinder drum 7 is in contact is for this purpose located on a rocker body 100 which is located in the housing 2 so that it can pivot around a pivoting axis SA. The pivoting axis SA of the rocker body 100 and, thus, of the cylinder drum 7 lies at the point of intersection S of the axis of rotation $R_t$ of the drive shaft and the axis of rotation $R_t$ of the cylinder drum 7 and is perpendicular to the axes of rotation $R_t$ and $R_z$.

Depending on the position of the rocker body 100, the angle of inclination $\alpha$ of the axis of rotation $R_z$ of the cylinder drum 7 to the axis of rotation $R_t$ of the drive shaft 4 varies. The cylinder drum 7 can be pivoted into a null position in which the axis of rotation $R_z$ of the cylinder drum 7 is coaxial with the axis of rotation $R_t$ of the drive shaft 4.

Starting from this null position, the cylinder drum 7 can be pivoted to one or both sides, so that the axial piston machine in FIG. 5 can be in the form of a unilaterally pivotable or bilaterally pivotable variable displacement machine. A device for the pivoting of the rocker body 100 and, thus, of the cylinder drum 7 is not illustrated in detail in FIG. 5.

FIG. 6 shows one exemplary embodiment of the axial piston machine 1 in which the midpoints M of the articulated joints 20 of the pistons 10 with the drive flange 3 in the longitudinal direction of the cylinder drum 7 are located at least partly inside the cylinder drum 7. During rotation of the cylinder drum 7 the midpoints M of the articulated joints 20 are located at least partly inside the longitudinal extension of the cylinder drum 7. In FIG. 6, on the top piston 10 which is in the top dead center position in FIG. 6, a dimension L is indicated, by which the midpoints M of the articulated joints 20 project into the piston bores 8 of the cylinder drum 7. Finger-shaped protrusions 3*b* are formed on the end surface of the drive flange 3 facing the cylinder drums 7, on the ends of which the spherical shells 3*a* of the articulated joints 20 are located.

The roller pairs 50-53 of the cone-beam semi-roller joint 31, seen in FIG. 6 in the longitudinal direction of the cylinder drum 7, are located at least partly inside the cylinder drum 7.

The embodiment illustrated in FIG. 6 makes possible a compact construction of the axial piston machine 1 in the longitudinal direction of the drive shaft 4. There is also a larger open space between the drive shaft 4 and the cylinder drum 7. This larger open space can be utilized to enlarge the pivoting angle $\alpha$ of the cylinder drum 7 and, thus, to increase the power density of the axial piston machine 1 and/or to enlarge the diameter of the drive shaft 4 and, thus, to increase the transfer torque.

On the axial piston machine 1 illustrated in FIG. 7, instead of the bilateral mounting of the drive shaft 4 in the housing 2 illustrated in FIGS. 1, 5, and 6, the drive shaft 4 provided with the drive flange 3 is supported by two bearings 5*a*, 5*b* on one side and, is thus, supported in a cantilever fashion. The axial piston machine 1 in FIG. 7 is in the form of a variable displacement machine. It goes without saying that the axial piston machine can alternatively be in the form of a constant displacement machine. In the embodiment illustrated in FIG. 7, the cylinder drum 7 can be provided with the central longitudinal bore 11 for the passage of the drive shaft 4. However, the central longitudinal bore 11 of the cylinder drum 7 can also be omitted.

An axial piston machine 1 with a cone-beam semi-roller joint 31 for driving the cylinder drum 7 has a series of advantages.

The constant velocity joint in the form of a cone-beam semi-roller joint 31, with a corresponding choice of the angle of inclination $\gamma$ of the axes of rotation $RR_z$, $RR_r$ of the half-rollers, can be constructed in the form of a homokinetic constant velocity joint. The cone-beam semi-roller joint 31 which forms the constant velocity joint of the invention is suitable for use in axial piston machines 1 with a constant or variable displacement volume. In a variable displacement machine, no play results when the cylinder drum 7 pivots back to a reduced displacement volume. An additional significant advantage of the cone-beam semi-roller joint 31 is that the drive shaft 4 can be routed through the cylinder drum 7 and the axial piston machine 1 to create a torque transfer capability. The drive shaft 4 can be mounted on both sides of the cylinder drum 7 in the housing 2, which has advantages in terms of a compact construction of the axial piston machine 1 in the axial direction. The cone-beam semi-roller joint 31 has area contact. As a result of the area contact on the planar sliding surfaces GF of the two half-rollers of the roller pair 51-53, only low Hertzian stresses occur, as a result of which the cone-beam semi-roller joint 31 is not sensitive to and is robust in terms of its ability to withstand overloads which can occur, for example, as a result of high rotational acceleration. The cone-beam semi-roller joint 31 is therefore suitable for use in an axial piston machine 1, preferably a hydraulic motor, in applications with high rotational accelerations. On account of the low stresses that occur from the area contact on the planar sliding surfaces GF of the half-rollers, a surface treatment to protect against wear is necessary on the half-rollers only on the planar and flattened sliding surfaces GF. There is no need for a depth hardening of the half-rollers. As a result of the limited surface hardening of the half-rollers, which can be achieved by nitriding, for example, there is only a small change in the dimensions of the half-rollers so that a mechanical repair or finishing of the half-rollers is unnecessary. The low cost and the low amount of effort required for the manufacture of the half-rollers of the cone-beam semi-roller joint 31 results in little extra construction cost or effort for the axial piston machine 1 of the invention.

On the axial piston machine 1 of the invention, the function of the torque drive of the cylinder drum 7 by the cone-beam semi-roller joint 31 and the function of the support of the cylinder drum 7 by the spherical guide 25 are separate. Both functions are simple and economical to achieve in terms of manufacturing on account of the geometrically simple surfaces and components required. In particular, the receptacles for the half-rollers of the cone-beam semi-roller joint 31 and the half-rollers themselves can be manufactured easily and economically.

The invention is not restricted to the illustrated exemplary embodiments. The exemplary embodiment illustrated in FIG. 6 as a constant displacement machine can also be in the form of a variable displacement machine. In the embodiment illustrated in FIG. 7, the midpoints M of the articulated joints 20 can be alternatively located and immersed in the piston bore illustrated in FIG. 6. In addition, the axial piston machine illustrated in FIGS. 1, 5, 6, and 7, instead of an axial piston machine 1 that can be operated in both directions of rotation, can be an axial piston machine 1 that can be operated in a single direction of rotation, which simplifies the cone-beam semi-roller joint 31 accordingly.

The cone-beam semi-roller joint 31 is not restricted to the illustrated number of roller pairs. It goes without saying that for higher drive torques M2 of the cylinder drum 7 to be transmitted, instead of two pairs of rollers for each direction of rotation, a higher number of roller pairs can be used. Correspondingly, for lower drive torques M2 of the cylinder drum 7 to be transmitted, only one single roller pair per direction of rotation can be provided.

If the axial piston machine can only be operated in one direction of rotation, one roller pair or a plurality of roller pairs is required only for the desired direction of rotation to be able to transmit the drive torque M2 to the cylinder drum 7.

The drive-shaft-side receptacles 55*b*, 56*b*, 57*b*, 58*b* for the housing and support of the drive-shaft-side half-rollers 50*b*, 51*b*, 52*b*, 53*b*, as an alternative to being located in the drive shaft 4, can be located in the drive flange 3 or in a component that is connected in a torque-proof manner with the drive shaft 4. The drive flange 3 and the drive shaft 4 can also be separate, in which case the drive flange 3 is connected in a torque-proof manner with the drive shaft 4 by appropriate torque transmission means, such as gear teeth.

When the drive shaft 4 and the drive flange 3 are separate components, the drive-shaft-side receptacles 55*b*, 56*b*, 57*b*, 58*b* for the housing of the drive-shaft-side half-rollers 50*b*, 51*b*, 52*b*, 53*b* can also optionally be located in the drive flange 3 or the drive shaft 4.

The cylinder-drum-side receptacles 55*a*, 56*a*, 57*a*, 58*a* for the housing and support of the cylinder-drum-side half-rollers 50*a*, 51*a*, 52*a*, 53*a*, as an alternative to the configuration on the sleeve-shaped driver element 40, can be located directly on the cylinder drum 7, which is preferably provided with finger-shaped protrusions 41, 42, 43, 44.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic axial piston machine utilizing a bent-axis construction, comprising:

a drive shaft rotatable around an axis of rotation and provided with a drive flange;

a cylinder drum rotatable around an axis of rotation offset from the axis of rotation of the drive shaft;

a plurality of piston bores located in the cylinder drum and concentric to the axis of rotation of the cylinder drum;

a longitudinally displaceable piston located in each piston bore, wherein the pistons are fastened in an articulated manner to the drive flange; and a driving joint between the drive shaft and the cylinder drum for rotationally synchronous rotation of the cylinder drum and of the drive shaft, wherein the driving joint comprises a cone-beam semi-roller joint, wherein the cone-beam semi-roller joint comprises at least one roller pair with two semi-cylindrical half-rollers, wherein the semi-cylindrical half-rollers are flattened along an axis of rotation separate from the axis of rotation of the drive shaft and the axis of rotation of the cylinder drum and the half-rollers form flat sliding surfaces on the flattened sides at which the half-rollers of the roller pair are in contact with each other to form a contact surface.

2. The hydrostatic axial piston machine as recited in claim 1, wherein the half-rollers are located inside the pistons in the radial direction and at a distance from the axes of rotation of the drive shaft and of the cylinder drum.

3. The hydrostatic axial piston machine as recited in claim 1, wherein each roller pair has a cylinder-drum-side half roller associated with the cylinder drum and a drive-shaft-side half-roller associated with the drive shaft.

4. The hydrostatic axial piston machine as recited in claim 3, wherein the cylinder-drum-side half-roller of a roller pair is located in a cylindrical or partly cylindrical cylinder-drum-side receptacle and the drive-shaft-side half-roller of a roller pair is located in a cylindrical or partly cylindrical drive-shaft-side receptacle.

5. The hydrostatic axial piston machine as recited in claim 4, wherein the respective half-roller located in a cylindrical receptacle is secured in the receptacle in the longitudinal direction of the axis of rotation of the half-roller.

6. The hydrostatic axial piston machine as recited in claim 5, wherein the half-rollers include a collar on the cylindrical section which is engaged in a groove of the receptacle.

7. The hydrostatic axial piston machine as recited in claim 4, wherein the drive shaft-side receptacles are located in the drive shaft or in the drive flange.

8. The hydrostatic axial piston machine as recited in one of the claim 4, wherein the drive shaft-side receptacle is located in a component that is connected in a torque-proof manner with the drive shaft.

9. The hydrostatic axial piston machine as recited in claim 4, wherein the cylinder-drum-side receptacle is located in the cylinder drum or in a sleeve-shaped driver element connected in a torque-proof manner with the cylinder drum.

10. The hydrostatic axial piston machine as recited in claim 9, wherein the driver element or the cylinder drum includes at least one finger-shaped protrusion that extends toward the drive shaft and in each of which there is a cylinder-drum-side receptacle for a cylinder-drum-side half-roller.

11. The hydrostatic axial piston machine as recited in claim 10, wherein the drive shaft or the drive flange or the component connected in a torque-proof manner with the drive shaft includes at least one pocket-shaped recess in which the driver element is engaged with at least one finger-shaped protrusion, and wherein in each pocket-shaped recess there is a drive shaft-side receptacle for a drive shaft-side half-roller.

12. The hydrostatic axial piston machine as recited in claim 3, wherein the axis of rotation of the drive shaft-side half-roller is inclined with respect to the axis of rotation of the drive shaft at an angle of inclination and intersects the axis of rotation of the drive shaft.

13. The hydrostatic axial piston machine as recited in claim 3, wherein the axis of rotation of the cylinder-drum-side half-roller is inclined by an angle of inclination with respect to the axis of rotation of the cylinder drum and intersects the axis of rotation of the cylinder drum.

14. The hydrostatic axial piston machine as recited in claim 3, wherein the axis of rotation of the drive-shaft-side half-roller is inclined with respect to the axis of rotation of the drive shaft by a first angle of inclination, wherein the axis of rotation of the cylinder-drum-side half-roller is inclined by a second angle of inclination with respect to an axis of rotation of the cylinder drum, wherein the first and second angles of inclination are identical and the axis of rotation of the cylinder-drum-side half-rollers and the axis of rotation of the drive-shaft-side half-roller of each roller pair intersect in a plane perpendicular to a line bisecting the angle between the axis of rotation of the drive shaft and the axis of rotation of the cylinder drum, and the half-rollers of a roller pair are located in a vicinity of the point of intersection of the axes of rotation of the half-rollers.

15. The hydrostatic axial piston machine as recited in claim 1, wherein the axial piston machine is operable in both directions of rotation, and wherein there is at least one roller pair for each direction of rotation for rotationally synchronous drive of the cylinder drum.

16. The hydrostatic axial piston machine as recited in claim 1, including a plurality of roller pairs distributed over a periphery.

17. The hydrostatic axial piston machine as recited in claim 1, wherein the at least one roller pair is located in the longitudinal direction of the cylinder drum outside the cylinder drum.

18. The hydrostatic axial piston machine as recited in claim 1, wherein the at least one roller pair is located in the longitudinal direction of the cylinder drum at least partly inside the cylinder drum.

19. The hydrostatic axial piston machine as recited in claim 1, wherein the drive flange is formed in one piece with the drive shaft, or the drive flange and the drive shaft are separate parts with the drive flange connected in a torque-proof manner with the drive shaft.

20. The hydrostatic axial piston machine as recited in claim 1, wherein between the drive shaft and the cylinder drum there is a spherical guide.

21. The hydrostatic axial piston machine as recited in claim 1, wherein the cylinder drum includes a longitudinal bore located concentric to the axis of rotation of the cylinder drum and through which a portion of the drive shaft extends through the cylinder drum.

22. The hydrostatic axial piston machine as recited in claim 21, wherein a sleeve-shaped driver element is located in the longitudinal bore of the cylinder drum.

23. The hydrostatic axial piston machine as recited in claim 1, wherein the drive shaft includes torque transmission means on both ends for the transmission of torque.

24. The hydrostatic axial piston machine as recited in claim 1, wherein the drive shaft comprises a hollow shaft, through which a transfer shaft that extends through the axial piston machine extends.

25. The hydrostatic axial piston machine as recited in claim 1, wherein the drive shaft is mounted in a housing on one side in a vicinity of the drive flange.

26. The hydrostatic axial piston machine as recited in claim 1, wherein the drive shaft is mounted in a housing on both sides of the cylinder drum.

27. The hydrostatic axial piston machine as recited in claim 1, wherein midpoints of articulated joints of the pistons located outside the cylinder drum in the longitudinal direction of the cylinder drum.

28. The hydrostatic axial piston machine as recited in claim 1, wherein midpoints of articulated joints of the pistons are located at least partly inside the cylinder drum in the longitudinal direction of the cylinder drum.

29. The hydrostatic axial piston machine as recited in claim 1, wherein the axial piston machine is a constant displacement machine with a fixed displacement volume.

30. The hydrostatic axial piston machine as recited in claim 1, wherein the axial piston machine is a variable displacement machine with a variable displacement volume, wherein an inclination of the axis of rotation of the cylinder drum with respect to the axis of rotation of the drive shaft is variable.

* * * * *